US010674837B1

(12) United States Patent
Flannery et al.

(10) Patent No.: US 10,674,837 B1
(45) **Date of Patent: *Jun. 9, 2020**

(54) BED RAIL HAVING ROTATING SEAT FOR GUARD FRAME

(71) Applicant: Regalo International, LLC, Longboat Key, FL (US)

(72) Inventors: Mark A. Flannery, Longboat Key, FL (US); Porter R. Million, Minneapolis, MN (US)

(73) Assignee: Regalo International, LLC, Longboat Key, FL (US)

( * ) Notice: Subject to any disclaimer, the term of this patent is extended or adjusted under 35 U.S.C. 154(b) by 31 days.

This patent is subject to a terminal disclaimer.

(21) Appl. No.: 16/180,964

(22) Filed: Nov. 5, 2018

Related U.S. Application Data

(63) Continuation of application No. 15/043,981, filed on Feb. 15, 2016, now Pat. No. 10,117,524, which is a continuation of application No. 14/190,944, filed on Feb. 26, 2014, now Pat. No. 9,265,353, which is a continuation of application No. 13/914,596, filed on Jun. 10, 2013, now Pat. No. 8,726,433, which is a continuation of application No. 13/253,871, filed on Oct. 5, 2011, now Pat. No. 8,458,831.

(60) Provisional application No. 61/391,583, filed on Oct. 8, 2010, provisional application No. 61/406,995, filed on Oct. 26, 2010, provisional application No. 61/407,013, filed on Oct. 26, 2010, provisional (Continued)

(51) Int. Cl.

| | |
|---|---|
| ***A47D 15/00*** | (2006.01) |
| ***A47D 7/02*** | (2006.01) |
| ***A47C 21/08*** | (2006.01) |

(52) U.S. Cl.
CPC ..... *A47D 15/008* (2013.01); *A47C 21/08* (2013.01); *A47D 7/02* (2013.01); *A47D 15/00* (2013.01)

(58) Field of Classification Search
CPC .. A61G 7/0507; A61G 7/0508; A61G 7/0509; A61G 7/051; A61G 7/0512; A61G 7/0513; A61G 7/0514; A61G 7/0515; A61G 7/0516; A61G 7/0518; A61G 7/0519; A61G 7/052; A61G 7/0521; A61G 7/0522; A61G 7/0524; A47C 21/08; A47C 20/023; A47D 7/02
See application file for complete search history.

(56) References Cited

U.S. PATENT DOCUMENTS 2,891,258 A * 6/1959 Reichert ..... A61G 7/0507 5/428
3,045,259 A 7/1962 Mayer
(Continued)

FOREIGN PATENT DOCUMENTS

GB 2225716 A 6/1990

*Primary Examiner* — Eric J Kurilla
*Assistant Examiner* — Amanda L Bailey

(57) ABSTRACT

A bed rail having a guard frame that prevents a child from rolling off a bed and a pair of legs that extend between the mattress and box spring. The guard frame swings between up and down positions and is pivotally connected to the legs via a first junction. A second junction locks the guard frame to the legs. The second junction includes a rotatable seat that engages a pin extending from the guard frame. The bed rail further includes a strap that engages a proximal end of a leg, a distal end of the leg, and an anchor, which engages the side of the bed opposite of the bed rail.

16 Claims, 7 Drawing Sheets

Related U.S. Application Data application No. 61/407,902, filed on Oct. 28, 2010, provisional application No. 61/415,808, filed on Nov. 19, 2010.

(56) References Cited

U.S. PATENT DOCUMENTS

| | | | | |
|---|---|---|---|---|
| 3,290,701 | A | 12/1966 | Luff | |
| 3,823,428 | A * | 7/1974 | Whyte | A61G 7/0507 5/429 |
| 4,509,217 | A * | 4/1985 | Therrien | A61G 7/0507 5/428 |
| 4,724,559 | A | 2/1988 | Bly et al. | |
| 5,038,430 | A | 8/1991 | Bly | |
| 5,596,776 | A | 1/1997 | Huang | |
| 5,671,490 | A | 9/1997 | Wu | |
| 6,990,697 | B1 | 1/2006 | Clute | |
| 7,013,508 | B2 | 3/2006 | Wu | |
| 7,028,353 | B2 | 4/2006 | Waldman et al. | |
| 7,073,219 | B2 * | 7/2006 | Poulin | A61G 7/0507 5/425 |
| 7,103,928 | B1 | 9/2006 | Childs | |
| 7,302,720 | B2 | 12/2007 | Flannery et al. | |
| 7,373,679 | B2 | 5/2008 | Miller | |
| 7,640,606 | B2 | 1/2010 | Flannery et al. | |
| 7,913,333 | B2 | 3/2011 | Flannery et al. | |
| 8,458,831 | B2 | 6/2013 | Flannery et al. | |
| 8,555,436 | B2 | 10/2013 | Flannery | |
| 8,726,433 | B1 | 5/2014 | Flannery et al. | |
| 9,265,353 | B1 | 2/2016 | Flannery et al. | |
| 9,427,088 | B2 | 8/2016 | Miller | |
| 2004/0250347 | A1 * | 12/2004 | Brewin | A47C 21/08 5/426 |
| 2006/0162075 | A1 | 7/2006 | Waldman et al. | |
| 2007/0083994 | A1 | 4/2007 | Miller | |
| 2011/0179569 | A1 | 7/2011 | Hayano et al. | |
| 2012/0084915 | A1 | 4/2012 | Flannery et al. | |
| 2012/0084916 | A1 | 4/2012 | Flannery et al. | |

* cited by examiner

BED RAIL HAVING ROTATING SEAT FOR GUARD FRAME

This application is a continuation of U.S. patent application Ser. No. 15/043,981 filed Feb. 15, 2016 (U.S. Pat. No. 10,117,524 issued Nov. 6, 2018) and claims the benefit thereof under 35 U.S.C. § 120, which application is a continuation of U.S. patent application Ser. No. 14/190,944 filed Feb. 26, 2014 (U.S. Pat. No. 9,265,353 issued Feb. 23, 2016) and claims the benefit thereof under 35 U.S.C. § 120, which application is a continuation of U.S. patent application Ser. No. 13/914,596 filed Jun. 10, 2013 (U.S. Pat. No. 8,726,433 issued May 20, 2014) and claims the benefit thereof under 35 U.S.C. § 120, which application is a continuation of U.S. patent application Ser. No. 13/253,871 filed Oct. 5, 2011 (U.S. Pat. No. 8,458,831 issued Jun. 11, 2013) and claims the benefit thereof under 35 U.S.C. § 120, which application claims the benefit under 35 U.S.C. 119(e) of the following U.S. provisional application numbers: 1) 61/391,583 filed Oct. 8, 2010, 2) 61/406,995 filed Oct. 26, 2010, 3) 61/407,013 filed Oct. 26, 2010; 4) 61/407,902 filed Oct. 28, 2010; and 5) 61/415,808 filed Nov. 19, 2010, all of which nonprovisional and provisional applications are hereby incorporated by reference in their entireties into this application.

FIELD OF THE INVENTION

The present invention relates generally to a bed rail that prevents a child from falling out of bed, particularly to such a bed rail having a guard frame that extends upwardly beyond a sleeping surface of the bed and legs that extend between the mattress and box spring of the bed, and specifically to such a bed rail having a rotating seat that seats a portion of the guard frame.

BACKGROUND OF THE INVENTION

A bed rail is an apparatus that prevents a child from falling out of bed. Bed rail apparatus may be relatively expensive for at least three reasons. First, the apparatus may include relatively too many parts that need to be assembled at the factory or in the end use setting such as at a residence. Second, relatively many parts of the apparatus may be formed of an expensive metal such as steel. Third, relatively many parts of the apparatus may be complex in operation.

SUMMARY OF THE INVENTION

A feature of the present invention is the provision in a bed rail having a guard frame that prevents a child from rolling off the bed and a pair of legs extending between the mattress and box spring of the bed, of a first junction between the guard frame and the legs such that the guard frame can swing between up and down positions, and of a second junction between the guard frame and the legs to lock the guard frame relative to the legs and in the up position.

Another feature of the present invention is the provision in such a bed rail, of the second junction including a rotating seat for engaging a pin extending from the guard frame, where the rotating seat rotates in one direction to capture and contain the pin in the seat and to fix the guard frame in the up position, and where the rotating seat rotates in the other direction to orientate an opening of the seat along an arc through which the pin swings to permit the pin out of the seat, whereupon the guard frame can swing down to the down position.

Another feature of the present invention is the provision in such a bed rail, of the rotating seat engaging the pin extending from the guard frame, and of the rotating seat also engaging one of the legs, where the rotating seat includes a tab and where the leg includes a semi-circular slot having first and second ends, where the tab engages the slot, where the opening of the seat is aligned with the arc only when the tab engages the front or first end of the semi-circular slot, and where the seat captures and locks the pin when the tab is in any position other than the front and first end of the semi-circular slot.

Another feature of the present invention is the provision in such a bed rail, of the seat for the pin having a U-shaped interior seating portion that seats a head of the pin, where the U-shaped interior seating portion can intersect, when the seat is rotated, the arc defined by the head of the pin as the guard frame swings between the up and down positions.

Another feature of the present invention is the provision in such a bed rail, of the guard frame having a lower horizontally extending support member, an upper horizontally extending support member, and a pair of side vertically extending support members, where the lower horizontally extending support members extend outwardly and beyond each of the side vertically extending support members to provide a pair of pivot portions, and where the legs are pivotally joined to the pivot portions.

Another feature of the present invention is the provision in such a bed rail, of each of the legs of the bed rail having a proximal end and of the proximal end including a housing, where the housing includes outer and inner sidewalls, where the outer and inner sidewalls engage the pivot portion of the lower horizontally extending support member, and where the outer and inner sidewalls engage a shaft on which the rotatable seat pivots.

Another feature of the present invention is the provision in such a bed rail, of each of the legs of the bed rail having a proximal end and of the proximal end including a housing, of the housing having a generally upright portion and a generally horizontally extending portion, where the generally upright portion includes an inner surface, where the generally horizontally extending portion includes an upper surface, and where the inner surface leads into the upper surface to form a curved surface for confronting lower and side portions of a mattress.

Another feature of the present invention is the provision in such a bed rail, of each of the legs of the bed rail having a proximal end and of the proximal end including a housing, of the housing having a generally upright portion and a generally horizontally extending portion, where the leg includes a distal end and a tube between the proximal and distal ends, where the generally horizontally extending portion includes a receptor for the tube, where the bed rail further includes a) a pincher having a portion integral with the housing and being on a lower surface of the housing, b) a piece on the distal end of the leg and including a slot, c) an anchor for engaging a second side of the bed, and d) a strap engaging the pincher, the slot of the piece and the anchor such that pulling on the strap and placing tension on the strap draws the anchor relatively toward the housing such that the bed is squeezed between the anchor and the generally upright portion of the housing.

Another feature of the present invention is the provision in a bed rail, of limited combinations for assembly of a bed rail apparatus.

Another feature of the present invention is the provision in a bed rail, of a guard frame or rail portion that consists essentially of four parts.

Another feature of the present invention is the provision in a bed rail, of a guard frame or rail portion consisting of essentially four sections, where each section is an integral and one-piece independent section.

Another feature of the present invention is the provision in a bed rail, of a bed rail apparatus having only two combinations for correct assembly, and where other combinations are possible only with destroying the integrity of the bed rail apparatus.

An advantage of the present invention is simplicity. The first junction utilizes the lower horizontally extending support member. The lower horizontally extending support member extends outwardly and beyond the side vertically extending support members, and beyond the ends of the upper horizontally extending support member, to provide a pivot mount for the legs that extend between the mattress and box spring. The second junction utilizes a rotating seat that cooperates with the guard frame and that, at the same time, cooperates with the leg or, specifically, a housing on the proximal end of the leg. The rotating seat captures and contains a pin fixed to the guard frame. Rotation of the seat is controlled by a tab and slot relationship between the housing of the leg and the rotating seat.

Another advantage of the present invention is that the rotating seat includes only one position where the guard frame can swing out of the up position. In any other position of rotation, the pin of the guard frame cannot escape out of the rotating seat and hence the guard frame remains in the up position at all other positions of rotation.

Another advantage of the present invention is that metal parts are minimized. For example, the housing of the proximal end of the leg may be formed of a plastic, a portion of the pincher apparatus on the housing may be formed of plastic and be integral with the housing, the rotating seat may be formed of a plastic, the piece on the distal end of the leg may be formed of a plastic, and the anchor may be formed of a plastic.

Another advantage of the present invention is that the anchor is one-piece and integral.

Another advantage of the present invention is that no assembly of the anchor is required.

Another advantage of the present invention is that the strap that ties the anchor to the leg is permanently fixed to the anchor at the factory such as by looping the strap through a slot in the anchor and then stitching the free end of the strap back to a portion of the strap.

Another advantage of the present invention is of end user simplicity in setting up the bed rail after purchase. Few connections need to be made. The number of combinations for assembly are minimized such that correct assembly is the result.

DESCRIPTION

Figure 1A:
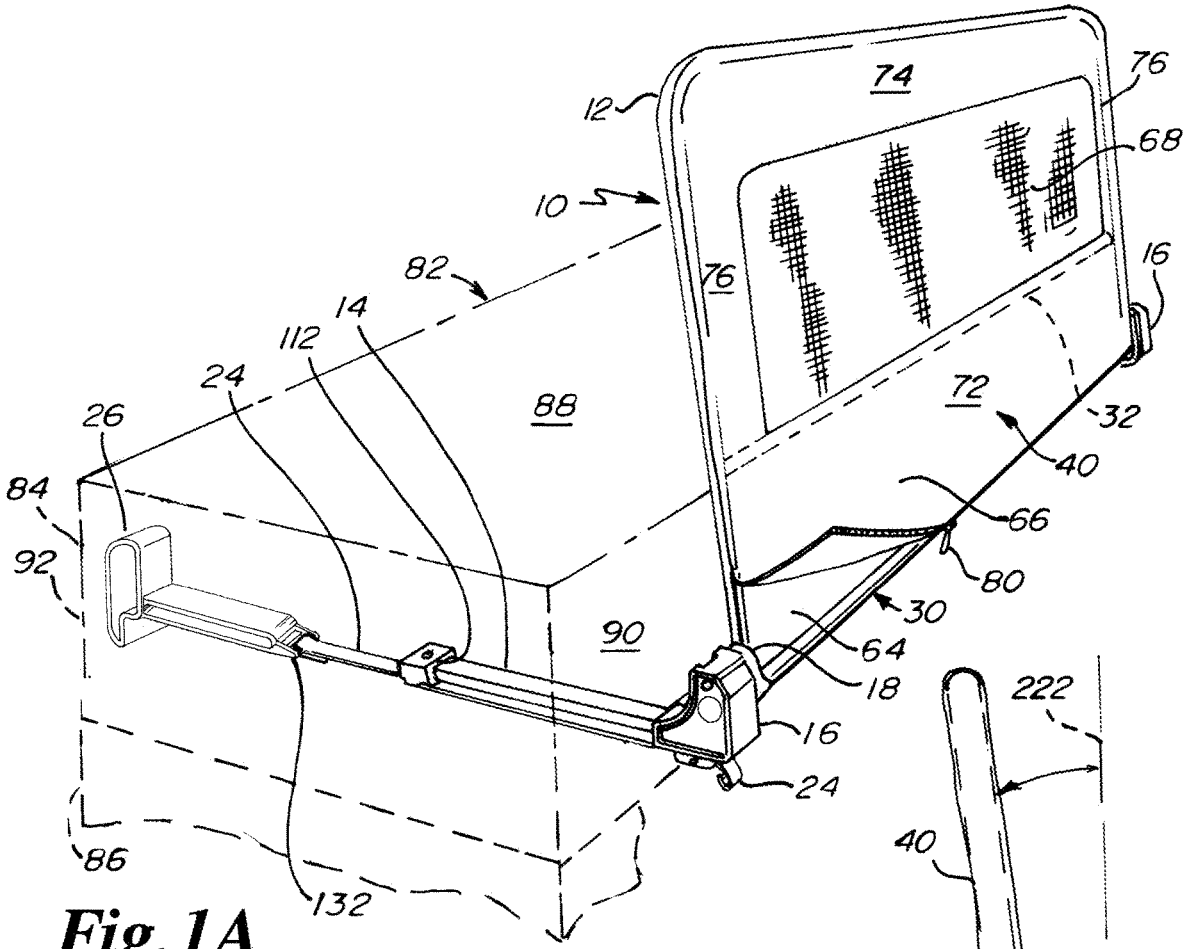
FIG. 1A is a perspective view of the present bed rail, showing the guard frame confronting a first side of the bed and showing one of the legs extending between the mattress and box spring of the bed.

As shown in FIG. 1A, the present bed rail is indicated by the reference numeral 10. Bed rail 10 generally includes a guard frame 12, a pair of legs 14 pivotally joined and lockable to the guard frame 12 via a housing 16, a rotating seat or rotatable seat or lock 18 between the housing 16 and the guard frame 12 where the rotating seat 18 seats a head 20 of a pin 22 extending from the guard frame 12, a strap 24, and an anchor 26.

The guard frame 12 includes an upper horizontally extending support member 28, a lower horizontally extending support member 30, a medial or middle horizontally extending support member 32 disposed between the upper and lower horizontally extending support members 28, 30, and a pair of side vertically extending support members 34. The support members 28, 30, 32, and 34 are tubular and formed of stainless steel.

Figure 1B:
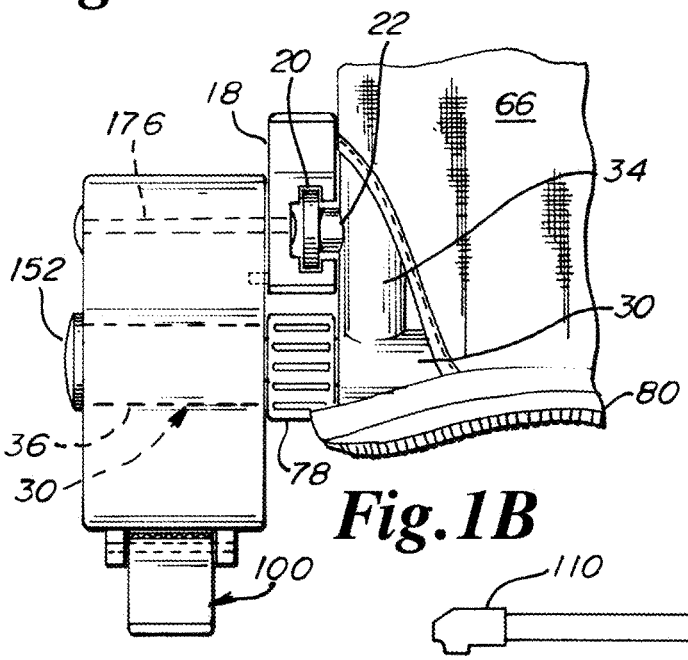
FIG. 1B is a front plan detail view of a portion of the bed rail of FIG. 1A showing first and second junctions between the guard frame and the leg, where the first junction is a pivot utilizing an extension from the lower horizontally extending support member of the guard frame and where the second junction is a rotatable seat seating a head of a pin extending from the guard frame, with the rotatable seat in turn pivotally engaging a housing of a proximal end of the leg.

As shown in FIG. 1B, the lower horizontally extending support member 30 extends outwardly and beyond the side vertically extending support members 34 to provide pivot portions 36 on which the housings 16 ride. Pivot portions 36 are aligned in a rectilinear fashion with lower horizontally extending support member 30. Pivot portion 36 and its engagement with housing 16 may be referred to as a first junction between each of the legs 14 and the guard frame 12. Pivot portion or pivot mount 36 extends beyond side vertically extending support member 34, beyond the end of upper horizontally extending support member 28, and beyond the end of medial horizontally extending support member 32. In other words, lower horizontally extending support member 30, by virtue of including pivot portion 36, is greater in length than upper horizontally extending support member 28 and is greater in length than medial horizontally extending support member 32.

Guard frame 12 may be defined to include tubing 38 and flexible sheeting 40 engaged over the tubing 38.

Figure 2A:
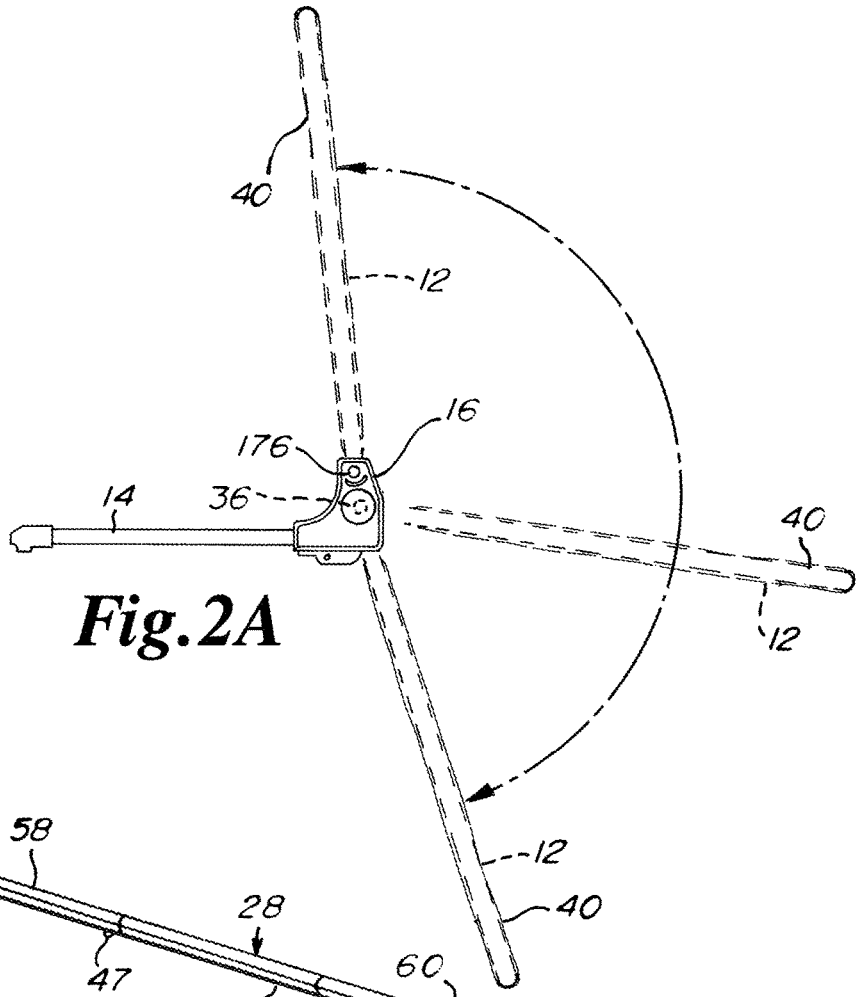
FIG. 2A is a side view of the bed rail of FIG. 1A and shows that the guard frame can swing between an up position and a down position.
Figure 2B:
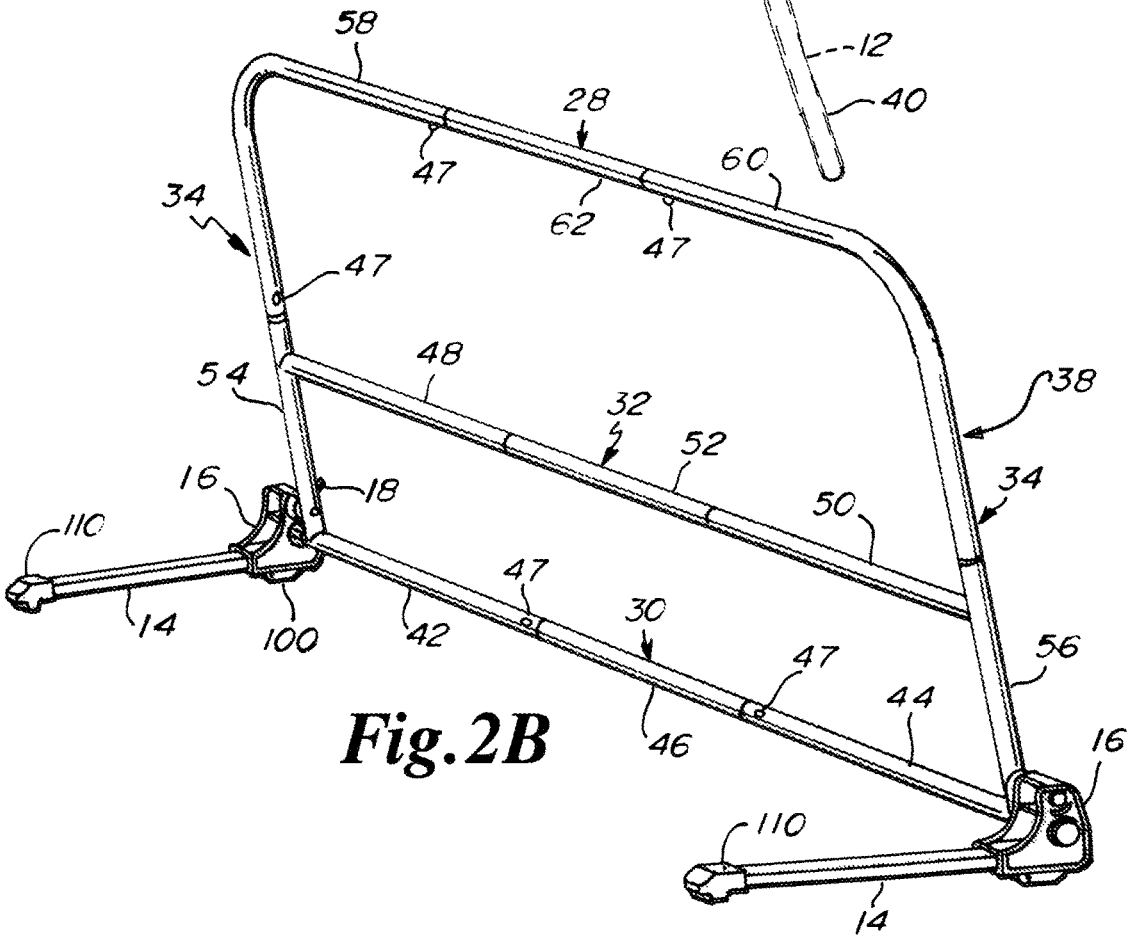
FIG. 2B is a perspective rear view of the bed rail of FIG. 1A without the sheeting that covers the guard frame.

As shown in FIG. 2B, tubing 38 includes three tubes 42, 44 and 46 that make up the lower horizontally extending support member 30. Tubes 42 and 44 are outer tubes that extend beyond the side vertically extending support members 34. Tubes 42 and 44 include as integral portions the pivot portions 36. Tube 46 is a middle tube that is engaged between the outer tubes 42 and 44 with a male/female connection where each of the outer ends of the middle tube 46 includes male ends that fit inside female ends on the inner ends of tubes 42 and 44. A spring based button 47 set inside of the male ends of tube 46 extends through an opening in the male end and then further through an opening in the female inner ends of tubes 42 and 44. When the button 47 is depressed, the tubes 42 and 44 may be slid off of tube 46.

Middle horizontally extending support member 32 includes a pair of outer tubes 48, 50 and a middle tube 52. The middle tube 52 has a pair of outer male ends that fit inside of female inner ends of outer tubes 48, 50. These male/female connections between tubes 48, 50 and 52 preferably do not have the spring based button 47. Outer tubes 48, 50 are rigidly fixed, such as by welding, to respective side vertically extending support members 34.

Tubing 38 further includes a pair of side vertically extending tubes 54, 56. The lower ends of tubes 54, 56 are rigidly affixed, such as by welding, to respective lower horizontally extending tubes 42, 44. Tubes 54, 56 extend at right angles to respective tubes 42, 44. Tubes 54, 56 are rigidly affixed, such as by welding, to respective tubes 48, 50 and extend at right angles to respective tubes 48, 50. Tubes 54, 56 engage via male/female connections respective upper L-shaped tubes 58, 60. Tubes 54, 56 have upper male ends and tubes 58, 60 have lower female ends. Tubes 54, 56 interconnect tubes 58, 60 with spring based button 47.

Each of the upper L-shaped tubes 58, 60 has an vertically extending portion and a horizontally extending portion. The vertically extending portion and the horizontally extending portion extend at a right angle to each other through a rounded corner integral junction. The vertically extending portion makes up part of the side vertically extending support member 34. The horizontally extending portion makes up part of the upper horizontally extending support member 28. Inner female ends of upper L-shaped tubes 58, 60 engage outer male ends of a top middle tube 62 with spring based buttons 47. Tube 62 is identical to tube 46.

Tube 62 and the horizontally extending portions of tubes 58 and 60 make up the upper horizontally extending support member 28. Tubes 42, 44 and 46 (and pivot portions 36) make up the lower horizontally extending support member 30. Tubes 48, 50 and 52 make up the middle horizontally extending support member 32. Tube 54 and the vertically extending portion of tube 58 make up one of the side vertically extending support members 34. Tube 56 and the vertically extending portion of tube 60 make up the side vertically extending support member 34.

Tubing 38 provides for compact packaging and, at the same time, correct installation. Compact packaging is provided for because one leg 14 is swingable into a substantially common plane with tubes 42, 54 and 48, because the other leg 14 is swingable into a substantially common plane with tubes 50, 44 and 56, because L-shaped tube 58 lies in a plane, because L-shaped tube 60 lies in a plane, because middle tubes 46, 52 and 62 also lie in respective planes.

Compact packaging is also provided for because each of the tube combinations or single tubes are relatively short in length. One tube combination that is short in length is tubes 42, 48 and 54 and its respective leg 14 and housing 16. The other tube combination that is short in length is tubes 44, 50 and 56 and its respective leg 14 and housing 16. The single tubes that are short in length are middle tubes 46, 52, and 62 and the L-shaped tubes 58 and 60.

Correct installation is provided for because: 1) the female inner end of tube 42 cannot be connected to the female inner end of tube 44, 2) the female inner end of the horizontally extending portion of tube 58 cannot be connected to the female inner end of the horizontally extending portion of tube 60, 3) the middle tubes 46, 52 and 62 are the same length, 4) middle tube 52 does not have the spring based buttons 47 and the inner ends of tubes 48, 50 do not have the button holes, 5) if the horizontally extending portion of tube 58 is oriented vertically, then middle tube 62, or any other middle tube 46 or 52, will be too short to join tubes 58, 60 and thus the end user will know he has reversed tube 58, and 6) if the horizontally extending portion of tube 60 is oriented vertically, then the middle tube 62, or any other middle tube 46 or 52, will be too short to joint tubes 58, 60 and thus the end user will know he or she has reversed tube 60.

Middle horizontally extending support member 32 lies a predefined distance away from lower horizontally extending support member 30. Such predefined distance is the thickness of a certain mattress such that when legs 14 are disposed between a mattress and a box spring, middle horizontally extending support member 32 lies in or close to the plane of the sleeping surface 88 of the mattress 84. Support members 30, 32 run parallel to each other. Guard frame 12 and its tubing 38 lie in substantially a common plane.

Flexible sheeting 40 is essentially an envelope. That is, flexible sheeting 40 includes a rear side 64 and a front side 66. Front side 66 includes a rectangular section of flexible mesh 68 and the rear side 64 includes an identical, but separate, section of flexible mesh 68. Each of the rear and front sides 64, 66 includes a lower translucent section 72 of a flexible material such as nylon, an upper translucent section 74 of a flexible material such as nylon, and a pair of side translucent sections 76 of a flexible material such as nylon. Sections 76 are between sections 72 and 74. Outer edges of sections 74, 76 of front side 66 are stitched to outer edges of sections 74, 76 of rear side 64. An upper portion of a side edge of section 72 of the front side 66 is stitched to an upper portion of a side edge of section 72 of the rear side 64. A lower portion of a side edge of section 72 of the front side 66 remains free of a lower portion of section 72 of the rear side 64 to provide space for the sheeting 40 to bypass the rotating seat 18, pin 22, head 20 of pin 22, and a spacer 78 on pivot portion 36. Lower edges of sections 72 are joined by a zipper apparatus 80. To remove the sheeting 40 from the tubing 38, the zipper apparatus 80 is unzipped such that the lower edges of sections 72 are free of each other. Then the sheeting 40 is pulled upwardly (in the orientation shown in FIG. 1A) and off of tubing 38. After washing, the lower open end of the sheeting 40, where the lower open end is formed by the free lower edges of sections 72, is placed over the upper horizontally extending support member 28 and drawn downwardly (in the orientation shown in FIG. 1A) until the free lower edges of sections 72 are beyond and below the lower horizontally extending support member 30, whereupon the zipper apparatus 80 is zipped so as to capture substantially an entirety of tubing 38 except for a joined corner junction of tubes 42 and 54 and a joined corner junction of tubes 44 and 56. When zipped, flexible sheeting 40 forms a tight but flexible barrier to prevent a child from rolling off a bed.

Mesh sections 68 are contained within flexible translucent sections 72, 74 and 76. Middle horizontally extending support member 32 runs along an upper edge of sections 72 and further runs immediately below and confronts a lower edge of mesh sections 68.

Figures 3A, 3B:
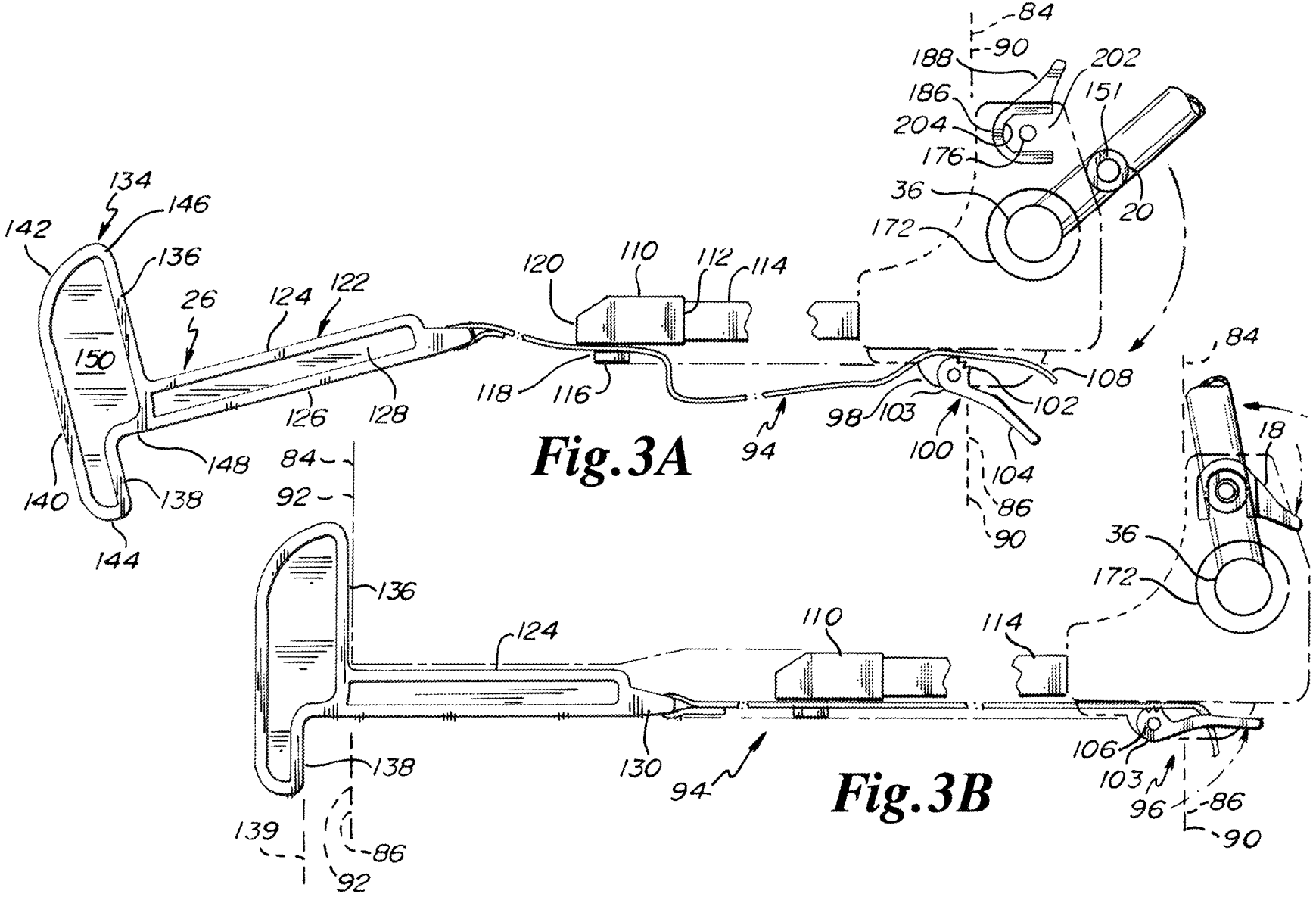
FIG. 3A is a side partial detail view of the bed rail of FIG. 1A showing the guard frame disengaged from the rotatable seat and swinging downwardly and further showing, as an independent event, the strap disengaged from the pincher and the anchor disengaged from the second side of the bed.
FIG. 3B is a side partial detail view of the bed rail of FIG. 1A showing the guard frame engaged with the rotatable seat and further showing, as an independent event, the strap engaged under tension in the pincher and the mattress being squeezed between the anchor and the housing on the proximal end of the leg.

As shown in FIGS. 1A, 3A and 3B, a bed 82 includes a mattress 84 and a box spring 86. Mattress 84 includes a sleeping surface 88. Bed 82 further includes a first side 90 and a second side 92 that is opposite to the first side 90.

As further shown in FIGS. 1A, 3A, and 3B, legs 14, housing 16, strap 24 and anchor 26 form part of an anchor apparatus 94 that anchors the guard frame 12 to the bed 82.

Anchor apparatus 94 includes a pincher or buckle mechanism 96. Pincher mechanism 96 includes a pair of pincher sidewalls 98 depending vertically and integrally from a lower surface of housing 16. Pivotally engaged between the pincher sidewalls 98 is pincher 100 having a set of teeth 102. When strap 24 is not between the teeth 102 and the lower surface of the housing 16, the tips of the teeth 102 make sliding contact with the lower surface of the housing 16 between the pincher sidewalls 98. Immediately between the pincher sidewalls 98 where the tips of teeth 102 make contact with the lower surface of the housing 16, the lower surface of the housing 16 is roughened. Such a roughened lower surface portion contributes to a tighter bite between the teeth 102 and the roughened lower surface portion when the strap 24 is engaged therebetween. Pincher 100 locks onto strap 24 when a pinching head 103 having teeth 102 rotates into the strap 24 and roughened surface portion.

Opposite of the proximal pinching head 103 is a distal finger and thumb grip 104 that rotates the pinching head 103 into locked and open positions. The open position of the pincher 100 is shown in FIG. 3A where the strap 24 can make sliding contact with a smooth portion of the pinching head 103. The locked position of the pincher 100 is shown in FIG. 3B where the strap 24 is pinched between the teeth 102 and the roughened surface portion of the lower surface of the housing 16. Pincher 100 includes a pivot pin 106 about which the pinching head 103 rotates. Pivot pin 106 engages the pincher sidewalls 98. Pincher 100 locks by virtue of a tight frictional bite to the strap 24 by the teeth 102 and roughened surface portion. Leverage providing a relatively tight bite is provided by the elongate leveraging finger and thumb grip 104 which, when in the locked position, confronts the lower surface of the housing 16. Further, when in the locked position, teeth 102 bite into strap 24.

If tension is applied to the strap 24 in a direction from the first side 90 of the bed 82 to the second side 92 of the bed 82, such as if an outward pressure is being applied to either or both of the anchor 26 and guard frame 12, then this tension has the effect of increasing the force of the bite and the teeth 102 dig even greater into the strap 24. This tension is such direction rotates the distal pincher grip 104 in an upward direction against the strap 24 and/or against the lower surface of the housing 16. If tension is applied to the strap 24 in a direction from the second side 92 of the bed 82 to the first side 90 of the bed 82, such as when a caregiver is pulling on the free end 108 of the strap 24 to tighten the anchor 26 or to tighten the hug between the anchor 26 and the inner surfaces of the housing 16, then the teeth 102 rotate away from tightening and the distal finger grip 104 rotates downwardly away from the lower surface of the housing 16, whereupon the strap 24 is easy to pull through the pincher 100 and whereupon when the desired degree of tension is obtained, the distal finger grip 104 is turned up to draw the teeth 102 into a bite with the strap 24 and the roughened surface portion of the lower surface of the housing 16.

Anchor apparatus 94 includes slotted piece 110 that is engaged on the distal end of leg 14. Piece 110 includes a receptacle 112 for a distal end of a tube 114 of the leg 14. Piece 110 is riveted to the distal end of tube 114. Piece 110 includes an extension 116 depending from the lower surface of piece 110. Extension 116 includes a slot 118 through which strap 24 slides and which supports strap 24 as strap 24 slides therethrough. Piece 110 includes a tapered end 120 such that leg 14 slides with less resistance through the space between the mattress 84 and the box spring 86. Leg 14 extends from the housing 16 to the piece 110 in a longitudinal direction and slot 118 extends in the longitudinal direction for the longitudinally sliding strap 24. Piece 110 is a distal portion of leg 14. Housing 16 is a proximal portion of leg 14.

Anchor apparatus 94 includes the anchor 26. Anchor 26 is one-piece and integral. Anchor 26 is a molded piece. Anchor 26 includes a horizontally or longitudinally extending body 122 that includes an upper horizontally extending rectangular plate 124 and a lower horizontally extending rectangular plate 126. The upper and lower plates 124, 126 are interconnected by a middle vertically extending plate 128. Plate 128 is fixed midway between opposite outer edges of plate 124. Plate 128 is fixed midway between opposite outer edges of plate 126. Plate or plate portion 128 is fixed at a right angle to plate or plate portions 124, 126.

Extending forwardly from the front ends of plates 122, 124 are a pair of extensions 130. A step or intermediate plate or plate portion 131 projects forwardly of plates or plate portions 124, 126 and is disposed on an elevation between plates or plate portions 124, 126. A post 132 is engaged between the inner front ends of the extensions 130. Plate or plate portion 131 and post 132 form a slot 133 therebetween. The distal end of the strap 24 is looped around the post 132, through slot 133 and stitched back to itself such that the connection between the anchor 26 and the strap 24 is a factory made connection, such that anchor 26 is not engaged to the strap 24 by the end user.

Extending transversely to the horizontal anchor body portion 122 is a vertical anchor body portion 134. Vertical anchor body portion 134 includes an upwardly extending vertical plate or plate portion 136 extending at a right angle to upper horizontally extending plate or plate portion 124 and to lower horizontally extending plate or plate portion 126. Vertical anchor body portion 134 includes a downwardly extending vertical plate or plate portion 138 extending at a right angle to upper horizontally extending plate or plate portion 124 and to lower horizontally extending plate or plate portion 126. Plates or plate portions 136 and 138 are offset from each other. Plate or plate portion 138 is disposed rearwardly of plate or plate portion 136. Plate or plate portion 136 may confront mattress 84 and plate or plate portion 138 may be spaced from the box spring 88. Or plate or plate portion 136 may confront a mattress and plate or plate portion 138 may confront a box spring at the same time where the mattress has dimensions slightly less than the dimensions of the box spring. Or plate or plate portion 136 may confront a mattress and plate or plate portion 138 may confront a base of a platform bed at the same time. A platform bed is a bed having a relatively hard base. As well as being relatively hard, such as formed from wood, the horizontal base may be raised and flat. The base then in turn supports a mattress without a box spring. The base may be a solid panel or may consist of slats. The slats may be relatively hard, but may also be resilient to some degree. The base of the platform bed may have dimensions slightly greater than the dimensions of the mattress that the base supports. Reference number 139, shown in FIG. 3B, designates an outer edge of a base for a platform bed. It should be noted that the term "base" by definition can refer to a box spring or to a base of a platform bed.

Vertical anchor body portion 134 further includes a vertical rear plate or plate portion 140 and a tapering upper plate or plate portion 142. Plate or plate portion 140 is parallel to plates or plate portions 136 and 138. A rounded corner plate or plate portion 144 runs from plate or plate portion 138 to plate or plate portion 140. A rounded corner plate or plate portion 146 runs from plate or plate portion 140 to plate or plate portion 136. A horizontally extending plate or plate portion 148 runs from the lower end of plate or plate portion 136 to the upper end of plate or plate portion 138.

Plates or plate portions 136, 148, 138, 144, 140, 142, 134 form a loop, are continuous with each other, and are integral and one-piece with each other.

Plate or plate portions 136, 148 and 138 have a first width or lateral length. Plate or plate portion 140 has a second width or lateral length that is less than the first width of plate or plate portions 136, 148 and 138. Side edges of plate or plate portion 144 taper inwardly from plate or plate portion 138 to plate or plate portion 140. Side edges of plate or plate portion 142 taper inwardly from the upper edge of plate or plate portion 136 to the upper edge of plate or plate portion 140.

Disposed midway between the outer edges of plates or plate portions 136, 148, 138, 144, 140, 142 and 146 is an upright plate 150 disposed at a right angle to plates or plate portions 136, 148, 138, 144, 140, 142 and 146. Upright plates 128 and 150 are substantially in a common plane with each other.

A "z" direction herein is a direction that runs at a right angle to both the lateral direction and the longitudinal direction. Plates or plate portions 136, 148, 138, 144, 140, 142 and 146 run laterally. Plates or plate portions 136, 138 and 140 run laterally and in the z direction. Plate or plate portion 150 runs longitudinally and in the z direction. Plates or plate portions 124 and 126 run in the lateral and longitudinal direction. Plate or plate portion 128 runs longitudinally and in the z direction.

Plates or plate portions 124 and 126 have a second width or lateral length. This second width is substantially equal to the second width of plate or plate portion 140.

The z directional length or height of plate or plate portion 136 is greater than the z directional length or height of plate or plate portion 138.

As shown in FIG. 1B, pin 22 extends in a lateral direction from side vertically extending support member 34. On one side of the guard frame 12, pin 22 extends outwardly at a right angle from tube 54. On the other side of the guard frame 12, pin 22 extends outwardly at a right angle from tube 56. Pin 22 includes head or pin head 20. Pin head 20 is formed generally in the shape of a disk and is integral and one-piece with pin 22 and the shaft of pin 22. Pin 22 and its head 20 can be affixed to side vertically extending support member 34 by an axially extending metal inner pin 151 having a pair of heads and a shaft, such as a rivet, where the axially extending metal inner pin 151 extends to and engages the inner side of tubes 54, 56 with a pin head, and where pin 22 and head 20 are formed of a plastic so as to slide relatively easily into the plastic rotatable seat 18. In other words, one metal head of pin 151 engages head 20 of plastic pin 22 and the other metal head of pin 151 engages the inner side of side vertically extending support member 34 to clamp plastic pin 22 and head 20 in place. It should be noted that the shaft of pin 22 does not extend into side vertically extending support member 34. Instead, the shaft of pin 22 includes a semi-circular recess that rides on the exterior round surface of side vertically extending support member 34 such that the shaft of pin 22 cannot spin or rotate and such that the head 20 of pin 22 cannot rotate. Pin 22, shaft of pin 22, and head 20 of pin 22 are one-piece and integral. Head 20 is spaced from the outer edge of side vertically extending support member 34 by the shaft of pin 22 to permit a portion of the rotatable seat 18 to extend between pin head 20 and the guard frame 12.

Pivot portion 36 extends beyond the side vertically extending support member 34 and runs parallel to the shaft of pin 22. Pivot portion 36 extends through housing 16 and is capped by a cap 152 that has a diameter greater than the outside diameter of the pivot portion 36. The diameter of cap 152 is further greater than openings in housing 16 through which pivot portion 36 extends so as to work as a lock to maintain housing 16 on pivot portion 36. Cap 152 includes an integral shaft that extends into pivot portion 36, which integral shaft is engaged by a pin extending in the diametrical direction through pivot portion 36, which pin keeps the cap 152 locked in place at the end of the pivot portion 36.

Annular spacer 78 is frictionally fit on the pivot portion 36 and is disposed between the housing 16 and the side vertically extending support member 34. Annular spacer 78 keeps housing 16 in place on the pivot portion 36 to minimize lateral movement of the housing 16 on the pivot portion 36. Annular spacer 78 provides space between the housing 16 and the guard frame 12 for rotation of rotatable seat 18.

Figure 4A:
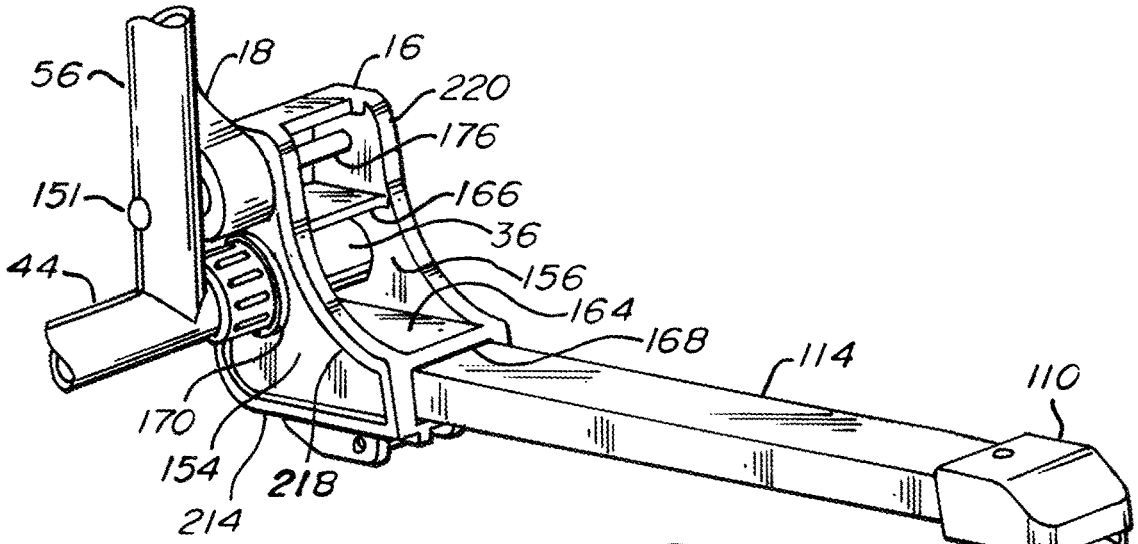
FIG. 4A is a rear perspective detail view of a portion of the bed rail of FIG. 1A showing the guard frame in the up position, further showing the head of the pin in the rotatable seat, and further showing the rotatable seat in the open position.
Figure 4B:
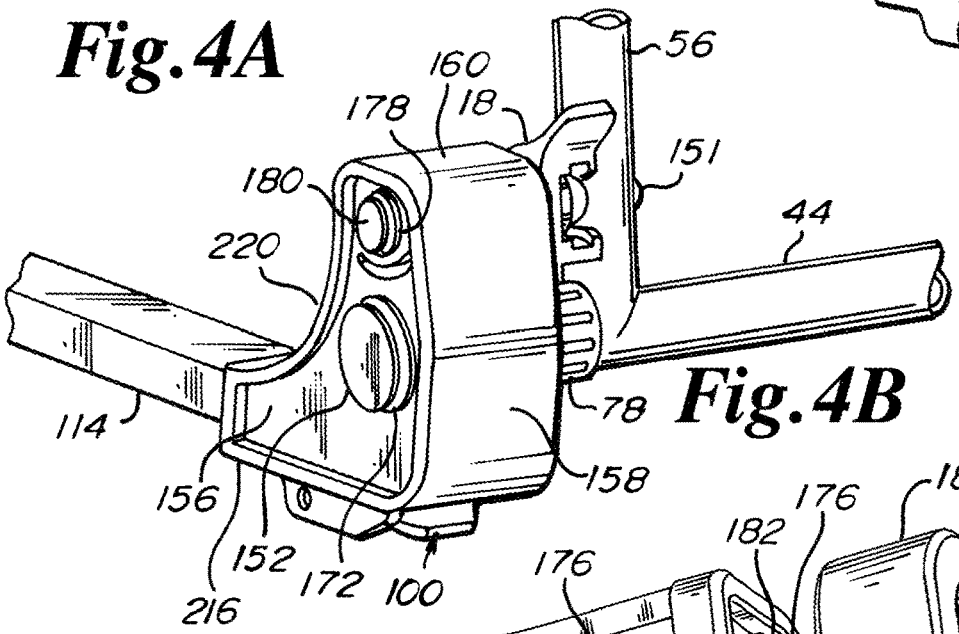
FIG. 4B is a front perspective detail view of a portion of the bed rail of FIG. 1A showing the guard frame in the up position, further showing the head of the pin in the rotatable seat, and further showing the rotatable seat in the open position.
Figure 4C:
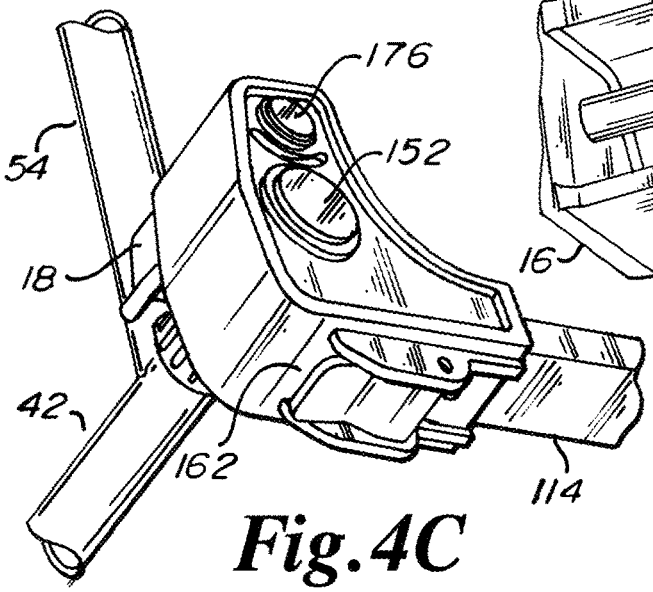
FIG. 4C is a bottom perspective detail view of a portion of the bed rail of FIG. 1A showing the guard frame in the up position, further showing the head of the pin in the rotatable seat, further showing the rotatable seat in the closed position, and further showing the pincher on the underside of the housing of the proximal end of the leg.
Figure 4D:
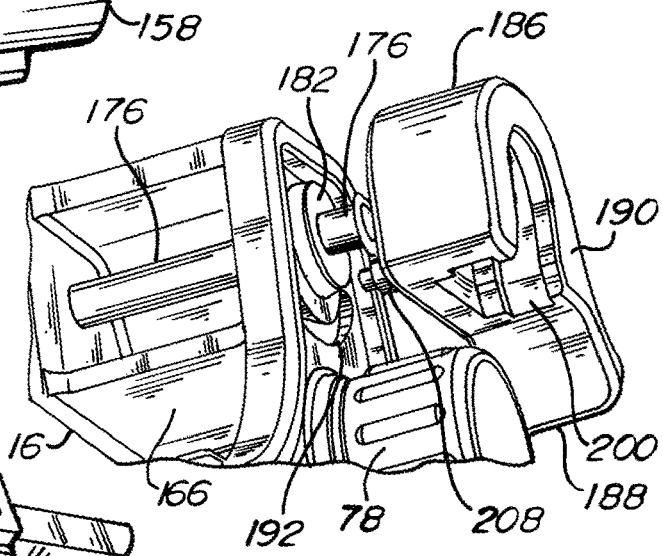
FIG. 4D is a rear perspective detail exploded view of a portion of the bed rail of FIG. 1A, showing the rotatable seat apart from the housing, showing a tab extending from the rotatable seat, and showing a semi-circular slot in the housing for engaging the tab.
Figure 5A:
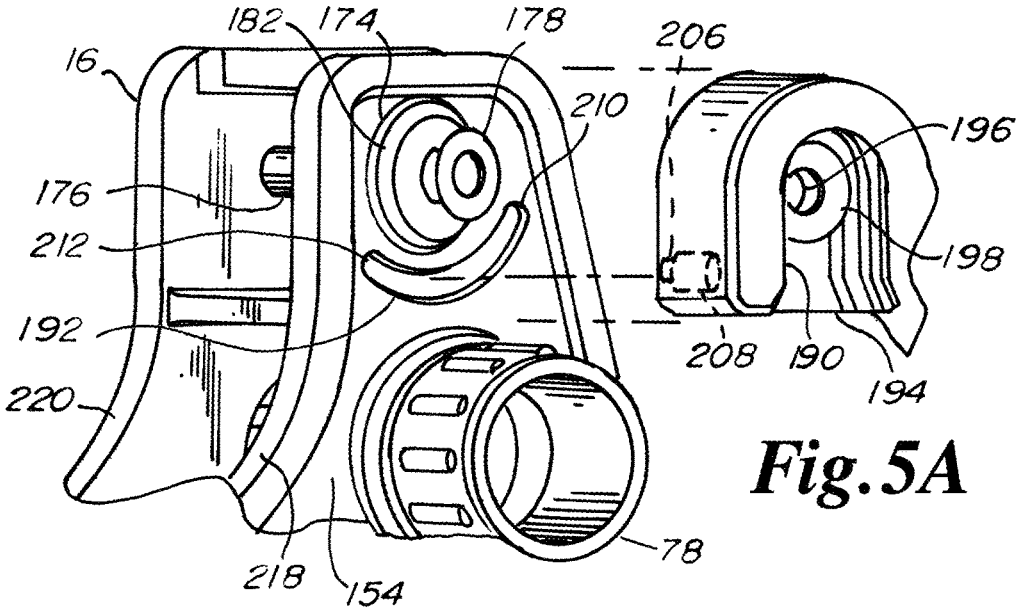
FIG. 5A is a rear perspective detail exploded and partially phantom view of a portion of the bed rail of FIG. 1A showing the rotatable seat apart from the housing, showing a tab extending from the rotatable seat, and showing a semi-circular slot in the housing for engaging the tab.
Figure 5B:
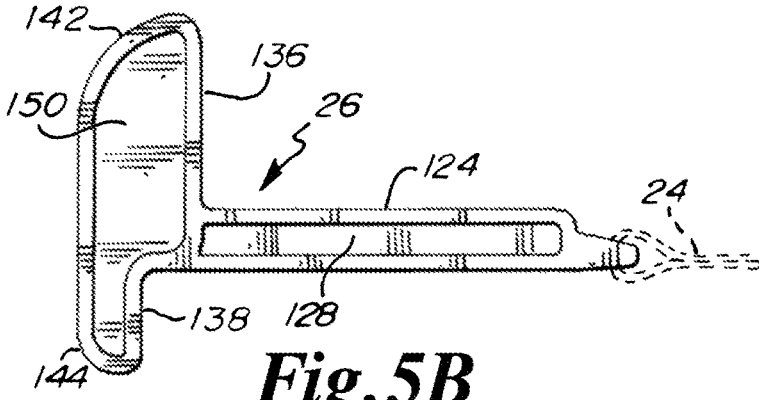
FIG. 5B is a side detail view of the anchor of the bed rail of FIG. 1A.
Figure 5C:
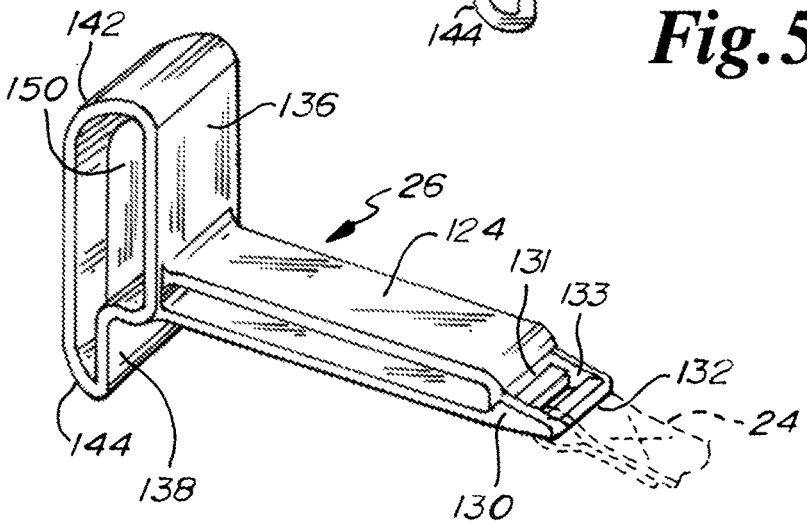
FIG. 5C is a perspective detail view of the anchor of the bed rail of FIG. 1A.

As shown in FIG. 4A, housing 16 includes an inner sidewall 154 and an outer sidewall 156. As shown in FIGS. 4B and 4C, the sidewalls 154, 156 are spaced apart by a front wall 158, a top wall 160, and a bottom wall 162. The sidewalls 154, 156 are further spaced apart by a lower inner horizontally extending wall 164. The sidewalls 154, 156 can further be spaced apart by an optional upper inner horizontally extending wall 166.

Walls 154, 156, 162 and 164 form a receptacle 168 for a proximal end of tube 114. Tube 114 is engaged at the factory to housing 16 via a pin or rivet extending in the z direction through tube 114 and walls 162 and 164.

Inner wall 154 includes a lower boss 170 forming an opening therein for reception of pivot portion 36. Outer wall 156 includes a lower boss 172 forming an opening therein for reception of another axial portion of pivot portion 36. Cap 152 confronts boss 172.

Inner wall 154 includes an upper boss 174 forming an opening therein for reception of a pin 176. Pin is a shaft or seat shaft for rotatable seat 18. Outer wall 156 includes an upper boss 178 forming an opening therein for reception of another axial portion of pin 176. Pins 176 and 151 are coaxial.

An inner end of pin 176 includes an annular flange 178. An outer end of pin 176 includes a cap or pin head 180 that confronts boss 178. Pin 176 can be a rivet with two heads 178, 180 such that, to take housing 16 and rotating seat 18 off the guard frame 12, the integrity of one or more of the pin 176, housing 16, rotating seat 18, and guard frame 12 must be destroyed.

A washer or spacer 182 is rotatably engaged on pin 176 and confronts boss 174 on one side and the rotatable seat 18 on the other side. Rotatable seat 18 is engaged on pin 176 between spacer 182 and the flange 178 of pin 176. Rotatable seat 18, pin 22, pin head 20, and pin 176 are coaxial with each other. Cap or pin head 180 is on one end of the pin 176 and the flange 178 is on the other end of pin 176 to lock rotatable seat 18 to housing 16 and, at the same time, permit rotation of the rotatable seat 18 relative to the housing 16.

Inner wall 154 includes a semi-circular slot 192 that is co-axial with pin 176. Semi-circular slot 192 extends for about 90 degrees about the pin 176. Semi-circular slot 192 is formed in inner wall 154 between the axis of pivot portion 36 and the axis of pin 176.

Rotatable seat 18 includes a generally U-shaped body 186 and a thumb and finger handle or extension 188 having an outer surface extending generally tangentially from a rounded outer surface of the U-shaped body 186 or seat 18. U-shaped body 186 includes an inner open U-shaped sidewall 190 having an open slot or second opening formed therein to provide for the passage of the shaft of pin 22 to move into and out of the open slot. Seat 18 is disposed between the housing 16 and the side vertically extending support member 34 when the guard frame 12 is in the up position. Seat 18 is formed generally in the shape of a hook.

U-shaped body 186 includes an outer sidewall 194 having an opening 196 formed therein by a boss 198. Pin 176 passes through opening 196 and flange 178 rides on boss 198. Pin 22, pin head 20, pin 176 and rotatable seat 18 may be referred to as a second junction between each of the legs 14 and the guard frame 12.

U-shaped body 186 includes a U-shaped channel 200 formed therein for receiving and engaging the head 20 of pin 22. U-shaped channel 200 includes a first opening 202 and a pin head seat 204 opposite of the opening 202. First opening 202 is greater in width than the open slot or second opening that is formed by inner open U-shaped sidewall 190. First opening 202 communicates with the open slot or second opening that is formed by inner open U-shaped sidewall 190.

U-shaped channel 200 can be referred to as a U-shaped interior seating portion having a closed end or seat 204 that seats the head 20 of pin 22. Closed end 204 is opposite of opening 202. The U-shaped interior seating portion or channel 200 includes opposing channel portions that intersect the arc defined by the swinging head 20 when the guard frame 12 is in the up position and the seat 18 is in a locked position, where the U-shaped interior seating portion or channel 200 confronts the point on the head 20 of the pin that is aligned with the arc to prevent the head 20 of the pin 22 from traveling along the arc forwardly or rearwardly when the guard frame is in the up position.

Rotatable seat 18 further includes a stem or tab 206 extending laterally from a stem base 208 that in turn extends laterally from the outer sidewall 194 of the U-shaped body 186. Stem 206 engages semi-circular slot 192 and the face of stem base 208 rides on the inner wall 154 of housing 16 adjacent to the semi-circular slot 192. Stem 206 and stem base 208 rotate with rotatable seat 18 from a front end or first stop 210 of slot 192 to a rear end or second stop 212 of slot 192.

In other words, leg 14 includes housing 16 which in turn includes the semi-circular slot 192 having first and second slot ends 210, 212. Seat 18 includes tab or stem 206 extending from the seat 18 toward leg 14. Tab 206 rides in semi-circular slot 192. Tab 206 prevents rotation of seat 18 in one direction when tab 206 engages the first slot end 210. Tab 206 prevents rotation of seat 18 in the other direction of rotation when tab 206 engages the second slot end 212. Guard frame 12 is locked in the up position when tab 206 engages rear or second slot end 212 and when head 20 is in the seat 18. Guard frame 12 is swingable out of the up position when the tab 206 engages the front or first slot end 210.

Further, guard frame 12 is locked in the up position when tab 206 is anywhere out of the first slot end 210 and when the head 20 is in the seat 18. The guard frame 12 is swingable out of the up position only when the tab 206 engages the first slot end 210.

Rotatable seat 18 has a locked position. This locked position is shown in FIGS. 1A, 3B, 4C, 4D, and 5A. This locked position is where the finger 188 is oriented at about the four o'clock position, as shown in FIG. 3B. This locked position is where the U-shaped channel 200 cuts across an arc defined by the swinging pin head 20. This locked position is where stem 206 is in the rear end 212 of slot 192. Also, it should be noted that the rotatable seat 18 is locked in substantially all rotatable positions except one. This one position or one exception is where stem 206 is located in the front end 210 of slot 192. Here the arc defined by the swinging head 20 communicates with the center of the opening 202, permitting the head 20 to slide out of the seat 204. Thus, if stem 206 is half-way between ends 210 and 212, the rotatable seat 18 is locked and the guard frame 12 cannot swing out of the up position. Further by way of example, if stem 206 is two-thirds of the way from end 212 to end 210, the rotatable seat 18 is locked and the guard frame 12 cannot open. The open position for the rotatable seat 18 is where stem 206 is in end 210 and where opening 202 is centered on the arc defined by the swinging head 20. The open position for the rotatable seat 18 is shown in FIGS. 1B, 2B, 3A, 4A, and 4B.

In other words, reference numeral 18 designates a seat for the head 20 of the pin 22. The seat 18 is pivotably engaged to leg 14 between an open position and a locked position. The seat 18 has a first opening 202 for the head 20 of the pin 22. The first opening 202 pivots with the seat 18 when the seat 18 is pivoted. An arc defined by the swinging head 20 is in communication with the first opening 202 when the seat 18 is in the open position to permit the head 20 of the pin 22 to travel along the arc and to slide into and out of the first opening 202 and into and out of the seat 18. The seat 18, or the channel 200 of the seat 18, cuts transversely across this arc at both forward and rearward locations of head 20 of the pin 22 when the first opening 202 is pivoted away from being in communication with the arc to define a locked position of the seat 18 such that the head 20 of the pin 22 is captured in the seat 18 and such that the head 20 of the pin 22 is prevented from swinging forwardly or rearwardly along the arc and such that the guard frame 12 is prevented from swinging out of the up position in either direction.

Inner wall 154 includes an inner peripheral lip 214. Outer wall 156 includes an outer peripheral lip 216.

Housing 16 includes a pair of inner and outer rear mattress confronting curved edges 218, 220 such that housing 16 operates as an anchor or counter member such that mattress 84 is squeezed between housing 16 and anchor 26 or, more specifically, between edges 218, 220 on the one hand and plate or plate portion 136 on the other hand. Housing 16 includes a generally upright portion that engages the pins 36 and 176.

Housing 16 includes a generally horizontally extending portion that engages tube 114. The generally upright portion of the housing 16 includes an inner surface. The generally horizontally extending portion of the housing 16 includes an upper surface. Such inner surface of the housing 16 leads into such upper surface of the housing 16 to form a curved surface for confronting lower and side portions of mattress 84. Such inner and upper surfaces and such curved surfaces are found on edges 218, 220.

Figure 1C:
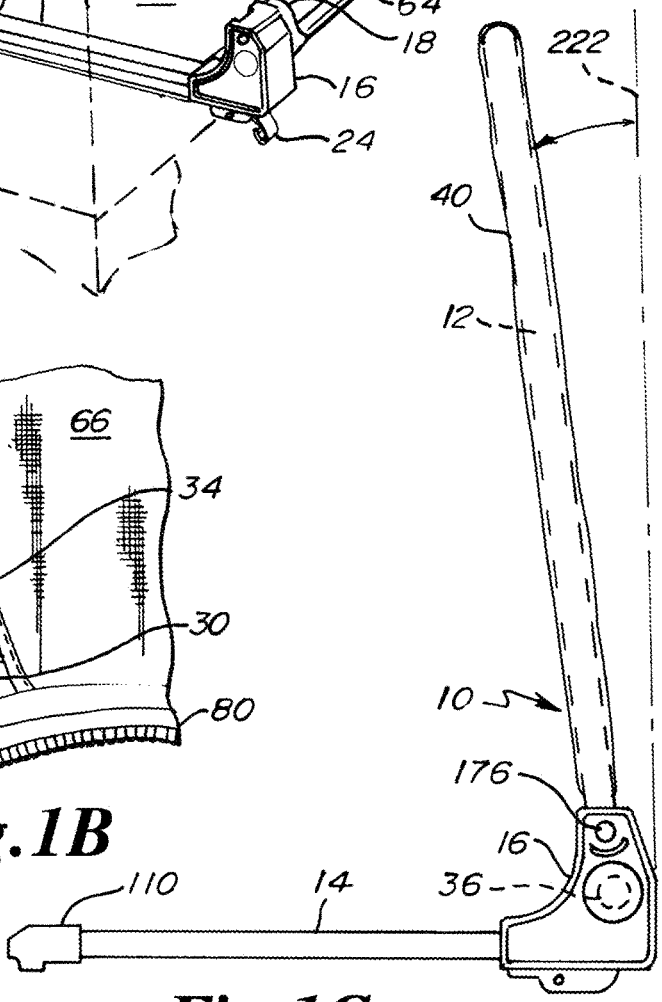
FIG. 1C is a side view of the bed rail of FIG. 1A showing an acute relationship between the legs of the bed rail and the guard frame of the bed rail.

Reference number 222 in FIG. 1C shows a true vertical axis that lies at a right angle to an axis of leg 14 and tube 114. Guard frame 12 preferably does not lie on this axis 222 but is set in a first plane oblique to the axis 222. Pivot portion 36 and lower horizontally extending support member 30 are coaxial and define a first axis. Pin 176 and pin 151 are coaxial and define a second axis. These first and second axis lie in the plane of the guard frame 12 such that guard frame 12 lies at a first acute angle relative to a longitudinal axis defined by leg 14 and tube 114. With the first acute angle, the chances are maximized that middle horizontally extending support member 32 confronts the sleeping surface 88 of the bed 82. The first acute angle is preferably between about 75 degrees and about 89 degrees, more preferably between about 78 and 88 degrees, yet more preferably between about 80 and 87 degrees, still more preferably between about 80 and 86 degrees, and most preferably about 82 degrees.

In operation, the first step may be set up or assembly of the bed rail 10. One pre-assembled package is: leg 14, housing 16, rotatable seat 18, distal end piece 110, pin 22 and pin head 20, spacer 78, tube 50, tube 56, and tube 44, including pivot portion 36. Another pre-assembled package is: leg 14, housing 16, rotatable seat 18, distal end piece 110, pin 22 and pin head 20, spacer 78, tube 48, tube 54, and tube 42, including pivot portion 36. Another pre-assembled package is: strap 24 and anchor 26. Another pre-assembled package is: the other strap 24 and the other anchor 26. Single pieces are: middle lower tube 46, intermediate middle tube 52, upper middle tube 62, L-shaped tube 58, and L-shaped tube 60. Thus, to set up or assemble the bed rail 10, the steps are: 1) engage lower middle tube 46 with tubes 42 and 44 and, at the same time, engage intermediate middle tube 52 with tubes 48 and 50; 2) engage middle tube 62 with L-shaped tubes 58 and 60; and 3) engage tubes 58 and 60 (having middle tube 62 therebetween) with tubes 54 and 56 respectively. Also, if desired at this time, the following steps can be taken: 4) insert the free or proximal end of the strap 24 through the slot 118 of the end piece 110 and then through the pincher 100; and 5) repeat step 4 with the other strap 24, i.e., insert the free or proximal end of the other strap 24 through the slot 118 of the other end piece 110 and then through the other pincher 100. However, it may be more convenient to perform steps 4 and 5 during installation.

In operation, to install the bed rail 10 to the bed 82, one anchor 26 is positioned at the second side 92 of the bed such that plate or plate portion 136 confronts the mattress 84. Then the strap 24 can be slid between the mattress 84 and box spring 86 from an end of the bed such that a free end of the strap 24 extends out from the first side 90 of the bed 82. Such step can be performed without lifting up the mattress 84. Then this same step is performed with the other anchor 26 and the other strap 24. Then the free or proximal end of the strap 24 is inserted through the slot 118 of the end piece 110 and then through the pincher 100. During this step of engaging the strap 24 with the leg 14, the user may start to slide the leg 14 between the mattress 84 and the box spring 86. Also during this step of engaging one of the straps 24 with one of the legs 14, the other strap 24 may begin to be engaged with the other of the legs 14. During this step of engaging the straps 24 with the legs 14, i.e., with the slot 118 and pincher 100, the tapered front end 120 facilitates sliding of the leg 14 into the space between the mattress 84 and box spring 86 and the anchor 26 serves as a counter to keep drawing the leg 14 therein. During this step of engaging, the pincher handle 104 may be alternately worked so that a user may fix one of the straps 24 at a newly shortened position, then proceed to the other housing 16 to tighten the other strap 24 and draw the other leg 14 further into the bed 82, and then proceed back to the first mentioned housing 16 to further tighten the first mentioned strap 24. Such back and forth steps are repeated until the mattress 84 is hugged or squeezed between the plate or plate portions 136 and the rear edges 218, 220 of the housing 16 and until the middle horizontally extending support member 32 is in the plane of the sleeping surface 88 and confronts the first side of the bed 90 at the junction of the first side 90 and the sleeping surface 88.

In operation, to swing the guard frame 12 to and between the up and down positions, the rotatable seat 18 is operated. The up position of the guard frame 12 is where the middle horizontally extending support member 32 is confronting the junction of the bed first side 90 and the sleeping surface 88. The down position of the guard frame 12 is where the guard frame 12 is disposed generally vertically and confronting the box spring 86 and where the pin head 20 is disposed below the pivot portion 36. To swing the guard frame 12 from the up position to the down position, the finger grip 188 of one rotatable seat 18 is swung upwardly until the stem 206 slides to the front end 210 of the slot 192. Then the finger grip 188 of the other rotatable seat 18 is swung upwardly until the stem 206 slides to the front end 210 of the slot 192. It should be noted that, unless each of the stems 206 slides fully to the its respective front end 210, the guard frame 12 will not swing out of the up position. This is so because the track 200 or the U-shaped channel 200 cuts across an arc defined by the head 20 of the pin 22 when the guard frame 12 swings between the up and down positions. In other words, this arc defined by the swinging pin 22 or the swinging pin head 20 communicates with and is centered with U-channel opening 202 for the pin head 20 to be permitted out of the rotatable seat 18. Upon such a communication, the guard frame 12 can swing from the up position to the down position, during which the pin head 20 slides out of the U-shaped channel 200. Then, to swing the guard frame 12 from the down position to the up position, the seat grips 188 are turned upwardly so as to expose the opening 202 of the U-shaped channel 200 until tabs 206 are in the front ends 210, then the guard frame 12 is gripped and rotated upwardly so as to swing the pin heads 20 into the U-shaped channels 200 and into the pin head seats 204, i.e., to the absolute rear ends of the U-shaped channels 200, a step that can be preformed if the seats 18 have been fully rotated, which full rotation has taken place if stem 206 is in the front end 210 of slot 192. At such position, the guard frame 12 is disposed with its middle horizontally extending support member 32 confronting the junction of the bed first side 90 and the sleeping surface 88. At this time, the finger grips 188 are rotated downwardly to lock the pin heads 20 in the seats 204 and where, at the same time, stem 206 is in rear end 212 of slot 212. In this locked position, the track 200 or the U-shaped channel 200 cuts across the arc defined by a swinging pin head 20, thereby preventing a swinging of the guard frame 12 out of the up position.

As to FIG. 3A, it should be noted that a) the step of loosening anchor apparatus 94, such as by loosening pincher 100, and b) the step of rotating rotatable seat 18 to the unlocked and open position are independent steps. That is, anchor apparatus 94 can be in a tight and hugging position (as shown in FIG. 3B) and the guard frame 12 can be swung between the up and down positions (as shown in FIG. 3A).

As to FIG. 3B, it should be noted that a) the step of tightening anchor apparatus 94, such as by pulling on the free end 108 of the strap 24 and pushing pincher grip 104 upwardly, and b) the step of locking the guard frame 12 in its upright and locked position by rotating seat 18 to its locked position are independent steps. That is, guard frame 12 can be in the up position (as shown in FIG. 3B) and locked in the up position (as shown in FIG. 3B) and the anchor apparatus 94 can be in a loosened position (as shown in FIG. 3A).

Further as to FIGS. 3A and 3B, preferably the anchor apparatus 94 is at all times (except when the bed rail 10 is set up or taken down) in the tightened and hugging position shown in FIG. 3B. This tightened and hugging position permits smooth operation of the rotatable seat 18 and maximizes the chances that the middle horizontally extending support member 32 confronts the junction of the bed first side 90 and the sleeping surface 88.

Figure 6A:
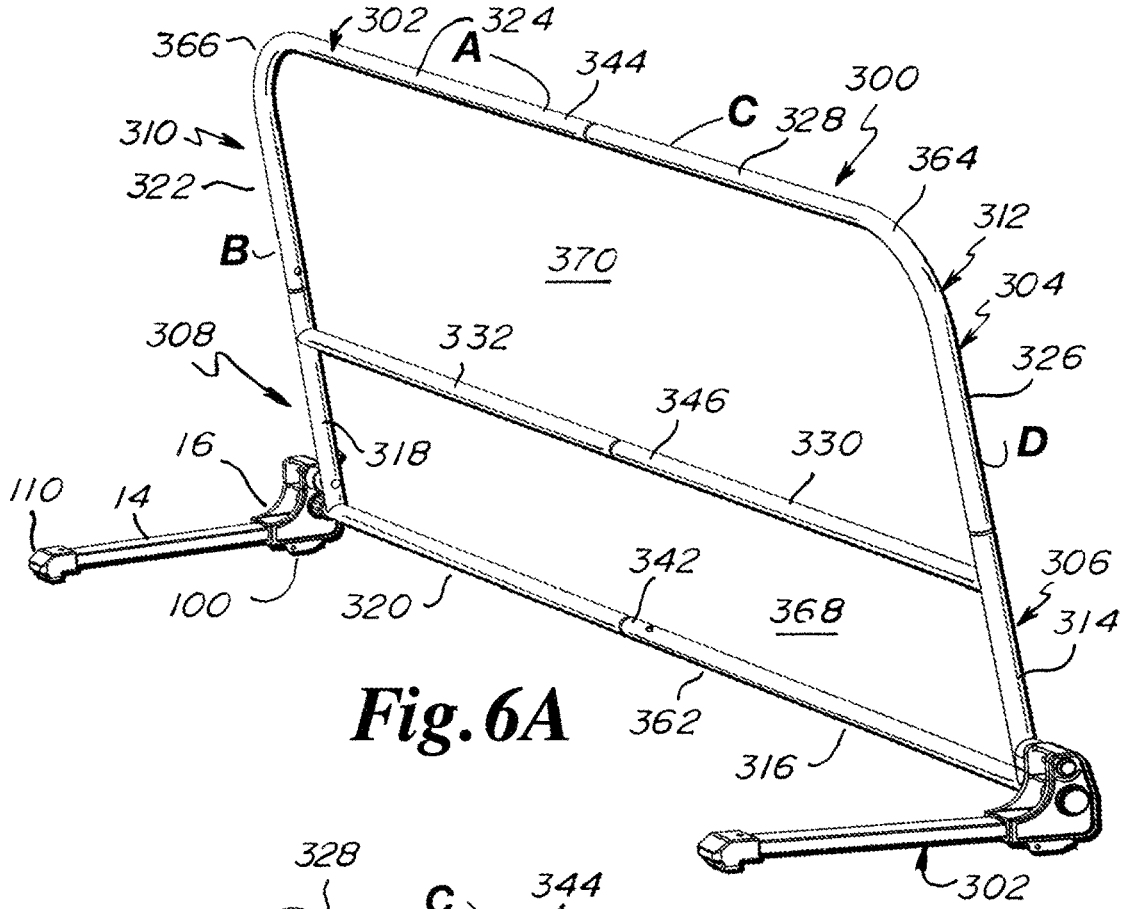
FIG. 6A is a perspective view of an alternate embodiment of the invention, in an operating configuration, that employs the same legs, same housing, and same rotating seat as the bed rail of FIG. 2B, but that employs a different guard frame or rail portion than the bed rail of FIG. 2B.
Figure 6B:
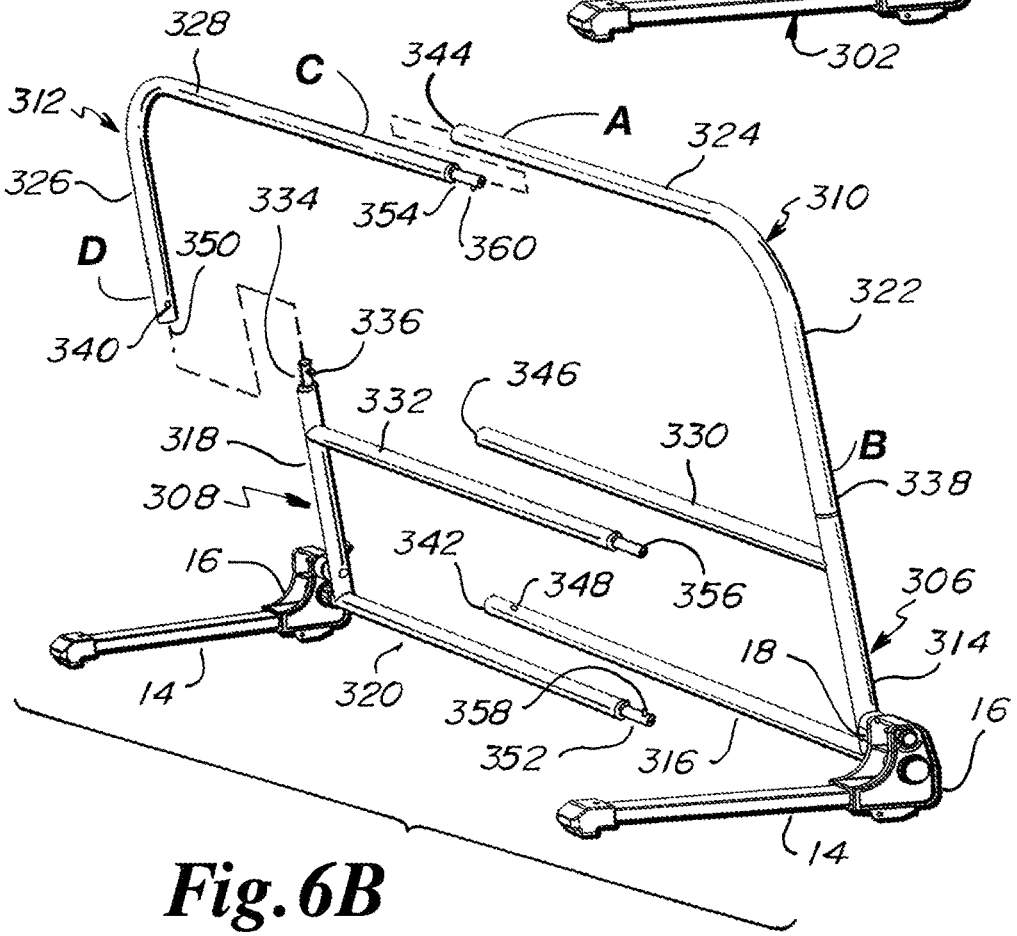
FIG. 6B is a perspective view of the bed rail of FIG. 6A in a broken down configuration.
Figure 7A:
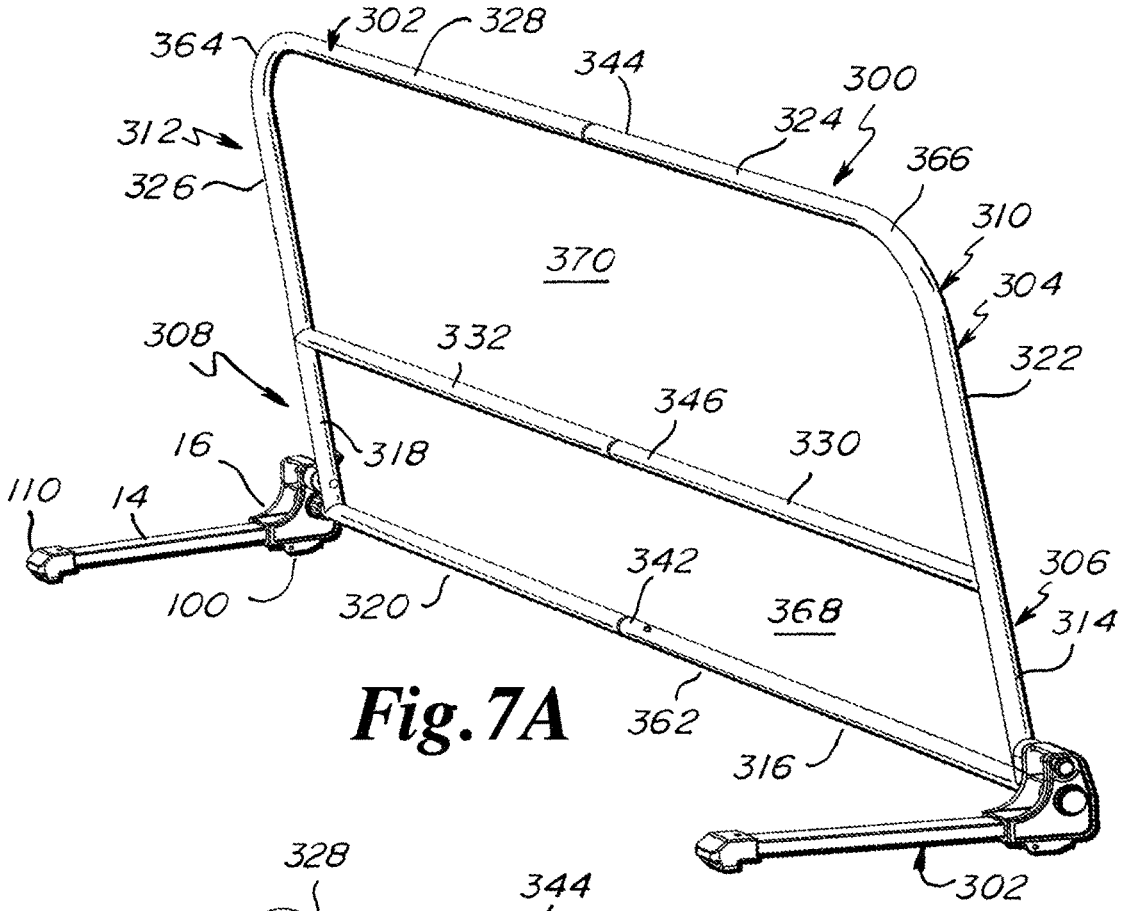
FIG. 7A is a perspective view of the bed rail of FIG. 6A, except that members 314, 322 and 324 are one-piece and integral and members 318, 326 and 328 are one-piece and integral.
Figure 7B:
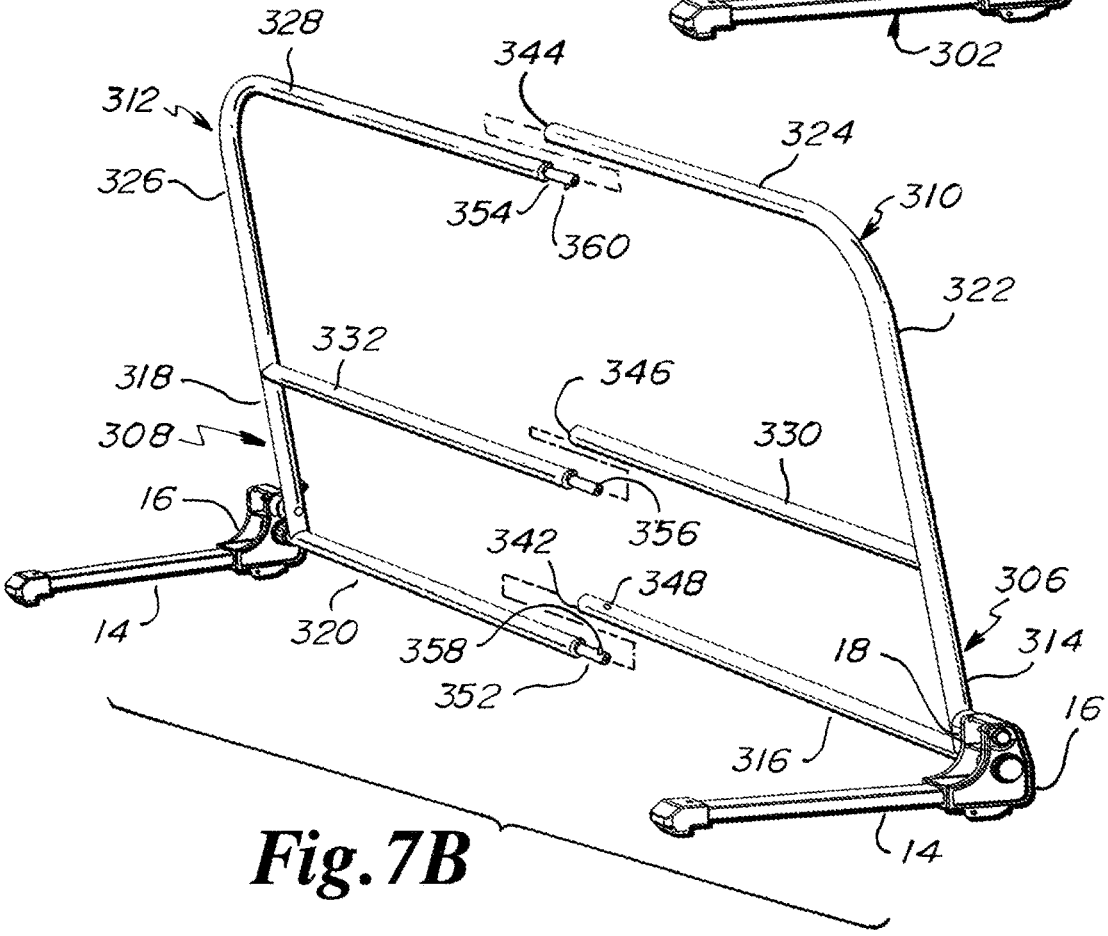
FIG. 7B is a perspective view of the bed rail of FIG. 6B, except that members 314, 322 and 324 are one-piece and integral and members 318, 326 and 328 are one-piece and integral.

FIGS. 6A and 6B show a bed rail or bed rail apparatus 300 for preventing a child from rolling off a bed, such as bed 82. Bed 82 may include mattress 84 and a base such as box spring 86. Mattress 84 may be disposed on the base 86. Bed 82 may include first and second sides 90, 92 that are opposite of each other. Bed 82 includes sleeping surface 88. Bed rail or bed rail apparatus 300 includes a bed rail frame 302 that in turn includes a guard frame 304 and legs 14. Guard frame 304 can also be referred to as a rail portion 304 of the bed rail 300.

Bed rail frame 304 includes an operating configuration shown in FIG. 6A and a broken down configuration shown in FIG. 6B. As shown in FIGS. 6A and 6B, bed rail frame 302 includes a first unit 306, a second unit 308, a third unit 310 and a fourth unit 312.

First unit 306 includes a right side vertical support member lower portion 314, a first right side horizontal support member lower portion 316, right side leg 14, a right side housing 16, and right side rotating seat 18. Portions 314 and 316 engage the housing 16 and seat 18 just like side tube 56 and outer tube 44 engage their respective housing 16 and seat 18. Right side lower portions 314, 316 are swingable relative to the right side leg 14. The right side lower portions 314, 316 are fixed to each other and to the right side leg 14 such that disassembly of the first unit 306 destroys the integrity of the first unit 306 or such that an end user must break or ruin the connections among one or more of portion 314, portion 316, leg 14, housing 16 and seat 18 to disassemble such parts from one another. It is intended that the end user not be able to break down the first unit 306. The strap 24 may or may not be included in the definition of the first unit 306 such that the strap 24 may or may not be intended to be removable by the end user.

The second unit 308 includes a left side vertical support member lower portion 318, a first left side horizontal support member lower portion 320 and the left side leg 14. The left side lower portions 318, 320 are swingable relative to the left side leg 14. The left side lower portions 318, 320 are fixed to each other and to the left side leg 14 such that disassembly of the second unit 308 destroys the integrity of the second unit or such that an end user must break or ruin the connections among one or more of portion 318, portion 320, leg 14, housing 16 and seat 18 to disassemble such parts from one another. It is intended that the end user not be able to break down the second unit 308. The strap 24 may or may not be included in the definition of the second unit 308 such that the strap 24 may or may not be intended to be removable by the end user.

The third unit 310 includes a right side vertical support member upper portion 322 and a right side horizontal support member portion 324 that are fixed to each other such that disassembly of the third unit 310 destroys the integrity of the third unit 310 or such that an end user must break or ruin the connection between portions 322 and 324 to disassemble such parts from one another. It is intended that the end user not be able to break down the third unit 310.

The fourth unit 312 includes a left side vertical support member upper portion 326 and a left side horizontal support member upper portion 328 that are fixed to each other such that disassembly of the fourth unit 312 destroys the integrity of the fourth unit 312 or such that an end user must break or ruin the connection between portions 326 and 328 to disassemble such parts from one another. It is intended that the end user not be able to break down the fourth unit 312.

In the operating configuration of the bed rail apparatus 300, the first unit 306 is removably engaged to the second unit 308, the third unit 310 is removably engaged to the fourth unit 312, the first unit 306 is removably engaged to one of the third and fourth units 310, 312, and the second unit 308 is removably engaged to the other of the third and fourth units 310, 312 such that, in the operating configuration of bed rail apparatus 300, when the right side leg 14 and left side leg 14 are disposed between the mattress 84 and the base 86 of the bed 82, a rail portion 304 of the bed rail 300 confronts the first side 90 of the mattress 84 of the bed 82.

The rail portion or guard frame 304 of the bed rail apparatus 300 includes the right side vertical support member lower portion 314 of the first unit 306, the first right side horizontal support member lower portion 316 of the first unit 306, the left side vertical support member lower portion 318 of the second unit 308, the first left side horizontal support member lower portion 320 of the second unit 308, the right side vertical support member upper portion 322 of the third unit 310, the right side horizontal support member portion 324 of the third unit 310, the left side vertical support member upper portion 326 of the fourth unit 312, and the left side horizontal support member upper portion 328 of the fourth unit 312.

In the broken down configuration and in the operating configuration, the first unit 306 further includes a second right side horizontal support member lower portion 330. The second right side horizontal support member lower portion 330 is fixed to the first unit 306 such that disassembly of the first unit 306 destroys the integrity of the first unit 306 or such that an end user must break or ruin the connection between portions 330 and 314 to disassemble such parts from one another. It is intended that the end user not be able to break down such a connection.

In the broken down configuration and in the operating configuration, the second unit 308 further includes a second left side horizontal support member lower portion 332. The second left side horizontal support member lower portion 332 is fixed to the second unit 308 such that disassembly of the second unit 308 destroys the integrity of the second unit or such that an end user must break or ruin the connection between portions 332 and 318 to disassemble such parts from one another. It is intended that the end user not be able to break down such a connection.

In the operating configuration, one of the first and second right side horizontal support member lower portions 316, 330 is disposed in or near the plane of the sleeping surface 88 of the mattress 84.

In the operating configuration, one of the first and second left side horizontal support member lower portions 320, 332 is disposed in or near the plane of the sleeping surface 88 of the mattress 84.

In the operating configuration, the right side vertical support member lower portion 314 includes an inner side and an outer side. The right side leg 14 of the first unit 306 is engaged to the first unit 306 at a location beyond the outer side of the right side vertical support member lower portion 314.

In the operating configuration, the left side vertical support member lower portion 318 includes an inner side and an outer side. The left side leg 14 of the second unit 308 is engaged to the second unit 308 at a location beyond the outer side of the left side vertical support member lower portion 318.

In the operating configuration, the right side vertical support member lower portion 314 of the first unit 306 is engagable to the right side vertical support member upper portion 322 of the third unit 310 and is not engagable to the right side horizontal support member upper portion 324 of the third unit 310.

In the operating configuration, the right side vertical support member lower portion 314 of the first unit 306 is engagable to the left side vertical support member upper portion 326 of the fourth unit 312 and is not engagable to the left side horizontal support member upper portion 328 of the fourth unit 312.

In the operating configuration, the left side vertical support member lower portion 318 of the second unit 308 is engagable to the left side vertical support member upper portion 326 of the fourth unit 312 and is not engagable to the left side horizontal support member upper portion 328 of the fourth unit 312.

In the operating configuration, the left side vertical support member lower portion 318 of the second unit 308 is engagable to the right side vertical support member upper portion 322 of the third unit 310 and is not engagable to the right side horizontal support member upper portion 324.

In the operating configuration, the first and second right side horizontal support member portions 316, 330 engage, respectively, the first and second left side horizontal support member portions 320, 332.

In the operating configuration, the right side horizontal support member upper portion 324 of the third unit 310 engages the left side horizontal support member upper portion 328 of the fourth unit 312.

Members 314, 316, 318, 320, 322, 324, 326, 328, 330 and 332 are tubes.

Member 314 is welded to member 316 and forms a T-shape therewith such that members 314, 316 extend at right angles to each other. An inner portion of member 316 extends inwardly of member 314. An outer portion of member 316 extends outwardly of member 314 and it is to this outer portion that housing 16 is engaged. Member 330 is welded to member 314 and forms a T-shape therewith such that members 314, 316 extend at right angles to each other. Members 316 and 330 run parallel to each other and are spaced apart from each other. Member 330 and the inner portion or inner extension of member 316 are the same length such that a straight line intersecting the distal ends of members 316 and 330 runs parallel to member 314.

Upper end of member 314 includes a male connection 334, shown in FIG. 6B on member 318. Male connection 334 includes a spring biased button 336 that is biased in the out position or locking position. Male connection 334 engages the open lower end or female connection 338 of member 322, which includes a button receiving opening 340 shown in FIG. 6B on member 326. Male connection 334 is a tubing portion that includes an outer diameter less than the outer diameter of the remaining portion of member 314. Female connection 338 is an open tubular end that includes an inner diameter equal to or slightly greater than the outer diameter of male connection 334.

Button 336 extends toward the inside of the guard frame 12 and opening 340 is formed on the inside face or inside side of member 322. Button 336 engages opening 340 to lock member 314 to member 322 and to lock the first unit 306 to the third unit 310. To unlock members 314, 322 from each other, button 336 is depressed and the members 314, 322 are slid apart. To lock members 314, 322 to each other, button 336 is depressed and the members 314, 322 are slid together until the button 336 automatically pops out of opening 340.

When the first unit 306 is locked to the third unit 310, members 316, 324 and 330 run parallel to each other. A straight line intersecting the distal ends or inner ends of members 316, 324 and 330 runs parallel to members 314 and 322. Members 314 and 322 are locked together in a straight line in the operating configuration.

Inner ends of members 316, 324, 330 include, respectively, female connections 342, 344, 346. Female connections 342, 344, 346 are open tubular ends having an inner diameter. Female connection 342 includes a button receiving opening 348 on an upper face that opens in a direction in line with member 314. Female connection 344 includes a button receiving opening on a lower face that opens in a direction in line with member 322. Female connection 346 includes no button receiving opening.

Member 318 is welded to member 320 and forms a T-shape therewith such that members 318, 320 extend at right angles to each other. An inner portion of member 320 extends inwardly of member 318. An outer portion of member 320 extends outwardly of member 318 and it is to this outer portion that housing 16 is engaged. Member 332 is welded to member 318 and forms a T-shape therewith such that members 318, 332 extend at right angles to each other. Members 320 and 332 run parallel to each other and are spaced apart from each other. Member 332 and the inner portion or inner extension of member 320 are the same length such that a straight line intersecting the distal ends of members 320 and 332 runs parallel to member 318.

Upper end of member 318 includes a male connection 334. Male connection 334 includes a spring biased button 336 that is biased to the out position or locking position. Male connection 334 engages the open lower end or female connection 350 of member 326, which includes a button receiving opening 340. Male connection 334 is a tubing portion that includes an outer diameter less than the outer diameter of the remaining portion of member 314. Female connection 350 is an open tubular end that includes an inner diameter equal to or slightly greater than the outer diameter of male connection 334.

Button 336 extends toward the inside of the guard frame 12 and opening 340 is formed on the inside face or inside side of member 326. Button 336 engages opening 340 to lock member 318 to member 326 and to lock the second unit 308 to the fourth unit 312. To unlock members 318, 326 from each other, button 336 is depressed and the members 318, 326 are slid apart. To lock members 318, 326 to each other, button 336 is depressed and the members 318, 326 are slid together until the button 336 automatically pops out of opening 340.

When the second unit 308 is locked to the fourth unit 312, members 320, 328 and 332 run parallel to each other. A straight line intersecting the distal ends or inner ends of members 320, 328 and 332 runs parallel to members 318 and 326. Members 318 and 326 are locked together in a straight line in the operating configuration.

Inner ends of members 320, 328, 332 include, respectively, male connections 352, 354, 356. Male connections 352, 354, 356 are tubular extensions having an outer diameter less than the outer diameter of their respective remaining portions.

Male connection 352 includes a spring biased button 358 that is biased toward the out or locking position, like button 336. The inner diameter of female connection 342 is equal to or slightly less than the outer diameter of male connection 352. Button 358 engages button receiving opening 348 of female connection 342. Button 358 extends in a direction that is parallel to member 318.

Male connection 354 includes a spring biased button 360 that is biased toward the out or locking position, like button 336. The inner diameter of female connection 344 is equal to or slightly less than the outer diameter of male connection 354. Button 360 engages a button receiving opening formed on the lower surface of female connection 344. Button 360 extends in a direction that is parallel to member 326.

Male connection 356 includes no spring biased button. The inner diameter of female connection 346 is equal to or slightly less than the outer diameter of male connection 356.

Bed rail apparatus 300 is assembled when 1) male connection 334 of the first unit 306 is coupled to the female connection 338 of the third unit 310, 2) male connection 334 of the second unit 308 is coupled to the female connection 338 of the fourth unit 312, 3) male connection 352 of the second unit 308 is coupled to the female connection 342 of the first unit 306, 4) male connection 354 of the fourth unit 312 is coupled to the female connection 344 of the third unit 310, and 5) male connection 356 of the second unit 308 is coupled to the female connection 346 of the first unit 306.

Assembly of bed rail apparatus 300 is, without destroying the integrity of the apparatus 300, possible in only in the intended fashion, and this intended fashion includes the positioning of the third unit 310 and fourth unit 312 either at the position shown in FIG. 6A or at the position shown in FIG. 6B. Any other possible combination of connections between male and female connections would not result in a functional bed rail apparatus 300.

Letters A, B, C and D in FIGS. 6A and 6B represent, respectively, members 324, 322, 328 and 326. Letters A, B, C and D show the interchangeability of the third and fourth units. Members A and B make up the third unit 310. Members C and D make up the fourth unit 312. In FIG. 6B, members A and B (the third unit 310) are on the right hand side of the drawing and members C and D (the fourth unit 312) are on the left hand side. In FIG. 6A, members A and B (the third unit 310) are on the left hand side of the drawing and members C and D (the fourth unit 312) are on the right hand side.

Bed rail apparatus 300 consists essentially of four parts. These four parts are first, second, third and fourth units 306, 308, 310 and 312. The first and second units 306, 308 includes the straps 24 and anchors 26.

Guard frame 12 of bed rail apparatus 300 consists essentially of four sections, where each section is an integral and one-piece independent section, where a first section is members 314, 316 and 330, where a second section is members 318, 320 and 332, where a third section is members 322 and 324, and where a fourth section is members 326 and 328.

Bed rail apparatus 300 may, if desired, consist of essentially two parts where the first unit 306 is formed as one-piece with third unit 310 and where the second unit 308 is formed as one-piece with the fourth unit 312. In this embodiment, members 314, 322 and 324 are one-piece and integral on the one hand, and members 318, 326 and 328 are one-piece and integral on the other hand.

Bed rail apparatus 300 may, if desired, consist of essentially two parts where the first unit 306 is formed as one-piece with second unit 308 and where the third unit 310 is formed as one-piece with the fourth unit 312. In this embodiment, members 316 and 320 are one-piece and integral on the one hand, and members 330 and 332 are one-piece and integral on the other hand.

In the operating configuration, as shown in FIG. 6A, the guard frame or rail portion 304 has an endless or unbroken perimeter 362. This endless perimeter 362 is formed, in sequence, by member 314, the inner extension of member 316, the inner extension of member 320, member 318, member 322, member 324, member 328, and member 326, the latter of which is connected to member 314 to complete the endless perimeter 362. The endless perimeter 362 is made possible by utilizing the outer portion or outer extension of members 316 and 320 to mount the legs 14, housing 16 and rotating seat 18. An advantage of the endless perimeter 362 is that sheeting 40 may be more easily engaged to the guard frame 304, without features such as the legs 14, housing 16 and rotating seat 18 interfering with or breaking up the endless feature or the sheeting 40 engaged to the perimeter.

Guard frame 304 includes upper rounded corner portions 364, 366. Member 322 curves upwardly and inwardly into member 324. Member 326 curves upwardly and inwardly into member 328.

Members 332, 330 lie in or close to the plane of the sleeping surface 88. Members 316, 320 lie in or close to the plane of the bottom of mattress 84. Between members 332, 330 on the one hand and members 316, 320 on the other hand, is a first space 368. This first space is generally the thickness of a mattress. Between members 330, 332 on the one hand, and members 324, 328 on the other hand, is a second space 370. Second space 370 has a greater height than does first space 368. In other words, a first vertical distance from member 316 to member 330 is less than a second vertical distance from member 330 to the straight portion of member 328.

Member 330 includes a first length as measured from the inner face of member 314 to the opposite inner distal free end. The inner extension of member 316 includes a second length as measured from the interior face of member 314 to the opposite inner distal free end. Member 332 includes a third length as measured from the inner face of member 318 to the opposite inner distal free end. The inner extension of member 320 includes a fourth length as measured from the inner face of member 318 to the opposite inner distal free end. The inner distal free ends of members 324, 328 are aligned, on a straight line, with the inner distal ends of members 330, 332, 316 and 320. These first, second, third and fourth lengths are equal, and such inner distal free ends are so aligned, to minimize space when the bed rail apparatus 300 is broken down for shipment or storage. In other words, a right half of the bed rail apparatus 300 has a length that is equal to the left half of the bed rail apparatus 300 and such determines the length (or width or one dimension) of the box used for shipment or storage.

Third unit 310 has a first height. This height is measured from the lower end of member 322, along the axis of member 322, to a straight line that is on the axis of member 324. Fourth unit 312 also has this first height. Member 314 has a second height. This second height is measured from the upper end of member 314, downward along the axis of member 314, to the underside of member 316. Member 318 also has this second height. These first and second heights of the units 306, 308, 310 and 312 are less than the length of leg 14 so as to minimize space when the bed rail apparatus is broken down for shipment or storage. In other words, the length of the legs 14 determines the width (or length or one dimension) of the box used for shipment or storage.

Members 332 and 318 meet at a junction that is offset from the upper end of member 318. Likewise, members 330 and 314 meet at a junction that is offset from the upper end of member 314.

In the operating configuration, members 320 and 316 are coaxial and form a first set, members 332 and 330 are coaxial and form a second set, and the straight portions of members 324 and 328 are coaxial and form a third set. These first, second and third sets are parallel to each other.

In the operating configuration, member 318 and the straight portion of member 322 (or the straight portion of member 326) are coaxial and form a fourth set, and member 314 and the straight portion of member 326 (or the straight portion of member 322) are coaxial and form a fifth set. These fourth and fifth sets are parallel to each other.

It should be noted that the guard frame or rail portion 304 of FIGS. 6A and 6B may replace the guard frame 12 of FIG. 2B and that the guard frame 12 of FIG. 2B may replace the guard frame or rail portion 304 of FIGS. 6A and 6B. In other words, the legs 14, housing 16, rotating seat 18 and their associated features described with respect to FIGS. 1A, 1B, 1C, 2A, 2B, 3A, 3B, 4A, 4B, 4C, 4D, 5A, 5B, and 5C may be utilized with respect to the guard frame or rail portion 304 shown in FIGS. 6A and 6B.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A rail portion for a bed rail for preventing a child from rolling off a bed, the bed having a mattress and a base, the mattress being on the base, the bed having first and second sides that are opposite of each other, the bed having a sleeping surface, the bed rail having a right side leg extending between the mattress and the base, the bed rail having a left side leg extending between the mattress and the base, the rail portion comprising:

a) a first unit comprising a right side end support member portion, a first right side transverse support member portion, and a second right side transverse support member portion, said right side end support member portion of the first unit, first right side transverse support member portion of the first unit, and second right side transverse support member portion of the first unit being swingable relative to the right side leg;

b) a second unit comprising a left side end support member portion, a first left side transverse support member portion, and a second left side transverse support member portion, said left side end support member portion of the second unit, first left side transverse support member portion of the second unit, and second left side transverse support member portion of the second unit being swingable relative to the left side leg;

c) a third unit comprising a right side end support member portion and a right side transverse support member portion that are fixed to each other such that disassembly of the third unit destroys the integrity of the third unit; and d) a fourth unit comprising a left side end support member portion and a left side transverse support member portion that are fixed to each other such that disassembly of the fourth unit destroys the integrity of the fourth unit;

e) wherein the first unit is removably engaged to the second unit by a pair of first and second intermediate support member portions, the first intermediate support member portion being engaged between the first right and left side transverse support member portions, the second intermediate support member portion being engaged between the second right and left side transverse support member portions;

f) wherein the third unit is removably engaged to the fourth unit by a third intermediate support member portion;

g) wherein the first unit is removably engaged to one of the third and fourth units; and h) wherein the second unit is removably engaged to the other of the third and fourth units;

i) such that, when the right side leg and left side leg are disposed between the mattress and the base of the bed, the rail portion of the bed rail confronts the first side of the mattress of the bed and comprises:

i) the right side end support member portion of the first unit;

ii) the first right side transverse support member portion of the first unit;

iii) the second right side transverse support member portion of the first unit;

iv) the left side end support member portion of the second unit;

v) the first left side transverse support member portion of the second unit;

vi) the second left side transverse support member portion of the second unit;

vii) the right side end support member portion of the third unit;

viii) the right side transverse support member portion of the third unit;

ix) the left side end support member portion of the fourth unit;

x) the left side transverse support member portion of the fourth unit; and xi) the first, second, and third intermediate support portions.

2. The rail portion of claim 1, wherein:

a) connections between the right side end support member portion of the first unit, first right side transverse support member portion of the first unit, and second right side transverse support member portion of the first unit are fixed such that disassembly of said connections destroys the integrity of said connections; and b) connections between the left side end support member portion of the second unit, first left side transverse support member portion of the second unit, and second left side transverse support member portion of the second unit are fixed such that disassembly of said connections destroys the integrity of said connections.

3. The rail portion of claim 1, wherein:

a) a connection between the right side end support member portion of the first unit and one of the first right side transverse support member portion of the first unit and second right side transverse support member portion of the first unit is fixed such that disassembly of said connection destroys the integrity of said connection; and b) a connection between the left side end support member portion of the second unit and one of the first left side transverse support member portion of the second unit and second left side transverse support member portion of the second unit is fixed such that disassembly of said connection destroys the integrity of said connection.

4. The rail portion of claim 1, wherein:

a) said second right side transverse support member portion of the first unit is intermediate said first right side transverse support member portion of the first unit and said right side transverse support member portion of the third unit;

b) said right side end support member portion of the first unit includes a first end and a second end; and c) said second right side transverse support member portion of the first unit is engaged to said right side end support member portion of the first unit at a location intermediate the first and second ends of said right side end support member portion of the first unit.

5. The rail portion of claim 1, wherein:

a) said second left side transverse support member portion of the second unit is intermediate said first left side transverse support member portion of the second unit and said left side transverse support member portion of the fourth unit;

b) said left side end support member portion of the second unit includes a first end and a second end; and c) said second left side transverse support member portion of the second unit is engaged to said left side end support member portion of the second unit at a location intermediate the first and second ends of said left side end support member portion of the second unit.

6. The rail portion of claim 1, wherein in an operating configuration where the bed rail extends upwardly beyond the sleeping surface the first unit is a lower unit, the second unit is a lower unit, the third unit is an upper unit and the fourth unit is an upper unit.

7. The rail portion of claim 1, wherein each of the first, second, and third intermediate support member portions includes first and second ends, each of said first and second ends of said first, second, and third intermediate support member portions being a male end.

8. The rail portion of claim 1, wherein each of the first, second, and third intermediate support member portions is a single piece.

9. A rail portion for a bed rail for preventing a child from rolling off a bed, the bed having a mattress and a base, the mattress being on the base, the bed having first and second sides that are opposite of each other, the bed having a sleeping surface, the bed rail having a right side leg extending between the mattress and the base, the bed rail having a left side leg extending between the mattress and the base, the rail portion comprising:

a) a first unit comprising a right side end support member portion, a first right side transverse support member portion, and a second right side transverse support member portion, said right side end support member portion of the first unit, first right side transverse support member portion of the first unit, and second right side transverse support member portion of the first unit being swingable relative to the right side leg;

b) a second unit comprising a left side end support member portion, a first left side transverse support member portion, and a second left side transverse support member portion, said left side end support member portion of the second unit, first left side transverse support member portion of the second unit, and second left side transverse support member portion of the second unit being swingable relative to the left side leg;

c) a third unit comprising a right side end support member portion and a right side transverse support member portion that are fixed to each other such that disassembly of the third unit destroys the integrity of the third unit; and d) a fourth unit comprising a left side end support member portion and a left side transverse support member portion that are fixed to each other such that disassembly of the fourth unit destroys the integrity of the fourth unit;

e) the first unit being removably engaged to the second unit by a pair of first and second intermediate support member portions, the first intermediate support member portion being engaged between the first right and left side transverse support member portions, the second intermediate support member portion being engaged between the second right and left side transverse support member portions;

f) the third unit being removably engaged to the fourth unit by a third intermediate support member portion;

g) the first unit being removably engaged to one of the third and fourth units; and h) the second unit being removably engaged to the other of the third and fourth units;

i) such that, when the right side leg and left side leg are disposed between the mattress and the base of the bed, the rail portion of the bed rail confronts the first side of the bed and comprises:

i) the right side end support member portion of the first unit;

ii) the first right side transverse support member portion of the first unit;

iii) the second right side transverse support member portion of the first unit;

iv) the left side end support member portion of the second unit;

v) the first left side transverse support member portion of the second unit;

vi) the second left side transverse support member portion of the second unit;

vii) the right side end support member portion of the third unit;

viii) the right side transverse support member portion of the third unit;

ix) the left side end support member portion of the fourth unit;

x) the left side transverse support member portion of the fourth unit; and xi) the first, second, and third intermediate support member portions;

j) wherein connections between the right side end support member portion of the first unit, first right side transverse support member portion of the first unit, and second right side transverse support member portion of the first unit are fixed such that disassembly of said connections destroys the integrity of said connections;

k) wherein connections between the left side end support member portion of the second unit, first left side transverse support member portion of the second unit, and second left side transverse support member portion of the second unit are fixed such that disassembly of said connections destroys the integrity of said connections;

l) wherein said right side transverse support member portion of the third unit engages said third intermediate support member portion which in turn engages said left side transverse support member portion of the fourth unit;

m) wherein said first right side transverse support member portion of the first unit engages said first intermediate support member portion which in turn engages said first left side transverse support member portion of the second unit;

n) wherein said second right side transverse support member portion of the first unit engages said second intermediate support member portion which in turn engages said second left side transverse support member portion of the second unit;

o) wherein said second right side transverse support member portion of the first unit is intermediate said first right side transverse support member portion of the first unit and said right side transverse support member portion of the third unit;

p) wherein said second left side transverse support member portion of the second unit is intermediate said first left side transverse support member portion of the second unit and said left side transverse support member portion of the fourth unit;

q) wherein said right side end support member portion of the first unit includes a first end and a second end, said second right side transverse support member portion of the first unit being engaged to said right side end support member portion of the first unit at a location intermediate the first and second ends of said right side end support member portion of the first unit; and r) wherein said left side end support member portion of the second unit includes a first end and a second end, said second left side transverse support member portion of the second unit being engaged to said left side end support member portion of the second unit at a location intermediate the first and second ends of said left side end support member portion of the second unit.

10. The rail portion of claim 9, wherein in an operating configuration where the bed rail extends upwardly beyond the sleeping surface the first unit is a lower unit, the second unit is a lower unit, the third unit is an upper unit and the fourth unit is an upper unit.

11. The rail portion of claim 9, wherein each of the first, second, and third intermediate support member portions includes first and second ends, each of said first and second ends of said first, second, and third intermediate support member portions being a male end.

12. The rail portion of claim 9, wherein each of the first, second, and third intermediate support member portions is a single piece.

13. A rail portion for a bed rail for preventing a child from rolling off a bed, the bed having a mattress and a base, the mattress being on the base, the bed having first and second sides that are opposite of each other, the bed having a sleeping surface, the bed rail having a right side leg extending between the mattress and the base, the bed rail having a left side leg extending between the mattress and the base, the rail portion comprising:

a) a first unit comprising a right side end support member portion, a first right side transverse support member portion, and a second right side transverse support member portion, said right side end support member portion of the first unit, first right side transverse support member portion of the first unit, and second right side transverse support member portion of the first unit being swingable relative to the right side leg;

b) a second unit comprising a left side end support member portion, a first left side transverse support member portion, and a second left side transverse support member portion, the left side end support member portion of the second unit, first left side transverse support member portion of the second unit, and second left side transverse support member portion of the second unit being swingable relative to the left side leg;

c) a third unit comprising a right side end support member portion and a right side transverse support member portion that are fixed to each other such that disassembly of the third unit destroys the integrity of the third unit; and d) a fourth unit comprising a left side end support member portion and a left side transverse support member portion that are fixed to each other such that disassembly of the fourth unit destroys the integrity of the fourth unit;

e) the first unit being removably engaged to the second unit by a pair of first and second intermediate support member portions, the first intermediate support member portion being engaged between the first right and left side transverse support member portions, the second intermediate support member portion being engaged between the second right and left side transverse support member portions;

f) the third unit being removably engaged to the fourth unit by a third intermediate support member portion;

g) the first unit being removably engaged to one of the third and fourth units; and h) the second unit being removably engaged to the other of the third and fourth units;

i) such that, when the right side leg and left side leg are disposed between the mattress and the base of the bed, the rail portion of the bed rail confronts the first side of the bed and comprises:

i) the right side end support member portion of the first unit;

ii) the first right side transverse support member portion of the first unit;

iii) the second right side transverse support member portion of the first unit;

iv) the left side end support member portion of the second unit;

v) the first left side transverse support member portion of the second unit;

vi) the second left side transverse support member portion of the second unit;

vii) the right side end support member portion of the third unit;

viii) the right side transverse support member portion of the third unit;

ix) the left side end support member portion of the fourth unit;

x) the left side transverse support member portion of the fourth unit; and xi) the first, second, and third intermediate support member portions;

j) wherein a connection between the right side end support member portion of the first unit and one of the first right side transverse support member portion of the first unit and second right side transverse support member portion of the first unit is fixed such that disassembly of said connection destroys the integrity of said connection;

k) wherein a connection between the left side end support member portion of the second unit and one of the first left side transverse support member portion of the second unit and second left side transverse support member portion of the second unit is fixed such that disassembly of said connection destroys the integrity of said connection;

l) wherein said right side transverse support member portion of the third unit engages said third intermediate support member portion which in turn engages said left side transverse support member portion of the fourth unit;

m) wherein said first right side transverse support member portion of the first unit engages said first intermediate support member portion which in turn engages said first left side transverse support member portion of the second unit;

n) wherein said second right side transverse support member portion of the first unit engages said second intermediate support member portion which in turn engages said second left side transverse support member portion of the second unit;

o) wherein said second right side transverse support member portion of the first unit is intermediate said first right side transverse support member portion of the first unit and said right side transverse support member portion of the third unit;

p) wherein said second left side transverse support member portion of the second unit is intermediate said first left side transverse support member portion of the second unit and said left side transverse support member portion of the third unit;

q) wherein said right side end support member portion of the first unit includes a first end and a second end, said second right side transverse support member portion of the first unit being engaged to said right side end support member portion of the first unit at a location intermediate the first and second ends of said right side end support member portion of the first unit; and r) wherein said left side end support member portion of the second unit includes a first end and a second end, said second left side transverse support member portion of the second unit being engaged to said left side end support member portion of the second unit at a location intermediate the first and second ends of said left side end support member portion of the second unit.

14. The rail portion of claim 13, wherein in an operating configuration where the bed rail extends upwardly beyond the sleeping surface the first unit is a lower unit, the second unit is a lower unit, the third unit is an upper unit and the fourth unit is an upper unit.

15. The rail portion of claim 13, wherein each of the first, second, and third intermediate support member portions includes first and second ends, each of said first and second ends of said first, second, and third intermediate support member portions being a male end.

16. The rail portion of claim 13, wherein each of the first, second, and third intermediate support member portions is a single piece.

* * * * *